US009925791B2

(12) United States Patent
Yamada

(10) Patent No.: US 9,925,791 B2
(45) Date of Patent: Mar. 27, 2018

(54) LIQUID EJECTION APPARATUS AND LIQUID EJECTION HEAD

(71) Applicant: CANON KABUSHIKI KAISHA, Tokyo (JP)

(72) Inventor: Kazuhiro Yamada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/387,334

(22) Filed: Dec. 21, 2016

(65) Prior Publication Data

US 2017/0197427 A1 Jul. 13, 2017

(30) Foreign Application Priority Data

Jan. 8, 2016 (JP) ..... 2016-003055
Dec. 9, 2016 (JP) ..... 2016-239793

(51) Int. Cl.
*B41J 2/18* (2006.01)
*B41J 2/19* (2006.01)
*B41J 2/175* (2006.01)

(52) U.S. Cl.
CPC ..... *B41J 2/18* (2013.01); *B41J 2/17563* (2013.01); *B41J 2/19* (2013.01); *B41J 2202/12* (2013.01); *B41J 2202/20* (2013.01)

(58) Field of Classification Search
CPC ..... B41J 2/18; B41J 2202/12
See application file for complete search history.

(56) References Cited

U.S. PATENT DOCUMENTS

| | | | | |
|---|---|---|---|---|
| 4,737,801 | A | 4/1988 | Ichihashi et al. | 347/85 |
| 4,748,459 | A | 5/1988 | Ichihashi et al. | 347/31 |
| 4,896,172 | A | 1/1990 | Nozawa et al. | 347/17 |
| 4,908,636 | A | 3/1990 | Saito et al. | 347/25 |
| 5,051,759 | A | 9/1991 | Karita et al. | 347/87 |
| 5,155,502 | A | 10/1992 | Kimura et al. | 347/87 |
| 5,166,707 | A | 11/1992 | Watanabe et al. | 347/3 |
| 5,189,443 | A | 2/1993 | Arashima et al. | 347/63 |

(Continued)

FOREIGN PATENT DOCUMENTS

| | | |
|---|---|---|
| JP | 03606282 | 1/2005 |
| JP | 03606282 | 4/2011 |
| WO | WO 03/041964 | 5/2003 |

OTHER PUBLICATIONS

U.S. Appl. No. 15/382,027, filed Dec. 16, 2016.

(Continued)

*Primary Examiner* — Shelby Fidler
(74) *Attorney, Agent, or Firm* — Fitzpatrick, Cella, Harper & Scinto

(57) ABSTRACT

A liquid ejection apparatus of the invention includes a liquid storage container that stores liquid, a plurality of print element boards including an ejection opening that ejects liquid and a pressure chamber that includes a print element generating energy for ejecting liquid therein, a common supply passage that supplies liquid to the plurality of print element boards, a supply-side filter provided in a passage between the liquid storage container and the common supply passage to remove a foreign substance from liquid, and a supply-side pressure adjustment mechanism provided in a passage at a downstream side of the common supply passage to adjust a pressure in the common supply passage.

17 Claims, 33 Drawing Sheets

(56) References Cited

U.S. PATENT DOCUMENTS

| | | | | |
|---|---|---|---|---|
| 5,216,446 | A | 6/1993 | Satoi et al. | 347/65 |
| 5,237,342 | A | 8/1993 | Saikawa et al. | 347/87 |
| 5,251,040 | A | 10/1993 | Saito | 358/296 |
| 5,280,299 | A | 1/1994 | Saikawa et al. | 347/87 |
| 5,291,215 | A | 3/1994 | Nozawa et al. | 347/18 |
| 5,329,304 | A | 7/1994 | Koizumi et al. | 347/7 |
| 5,471,230 | A | 11/1995 | Saito et al. | 347/29 |
| 5,481,283 | A | 1/1996 | Watanabe et al. | 347/33 |
| 5,481,290 | A | 1/1996 | Watanabe et al. | 347/104 |
| 5,483,267 | A | 1/1996 | Nemura et al. | 347/32 |
| 5,488,395 | A | 1/1996 | Takayanagi et al. | 347/7 |
| 5,500,666 | A | 3/1996 | Hattori et al. | 347/87 |
| 5,502,479 | A | 3/1996 | Ishinaga et al. | 347/93 |
| 5,515,091 | A | 5/1996 | Kimura et al. | 347/86 |
| 5,548,309 | A | 8/1996 | Okubo et al. | 347/33 |
| 5,559,536 | A | 9/1996 | Saito et al. | 347/25 |
| 5,565,900 | A * | 10/1996 | Cowger | B41J 2/14024 347/42 |
| 5,619,238 | A | 4/1997 | Higuma et al. | 347/86 |
| 5,623,287 | A | 4/1997 | Saikawa et al. | 347/47 |
| 5,629,728 | A | 5/1997 | Karita et al. | 347/87 |
| 5,689,290 | A | 11/1997 | Saito et al. | 347/7 |
| 5,703,632 | A | 12/1997 | Arashima et al. | 347/47 |
| 5,757,399 | A | 5/1998 | Murayama et al. | 347/32 |
| 5,864,352 | A | 1/1999 | Aoki et al. | 347/102 |
| 5,917,514 | A | 6/1999 | Higuma et al. | 347/29 |
| 5,917,524 | A | 6/1999 | Kimura et al. | 347/86 |
| 6,012,795 | A | 1/2000 | Saito et al. | 347/7 |
| 6,048,045 | A | 4/2000 | Nohata et al. | 347/7 |
| 6,056,386 | A | 5/2000 | Nohata et al. | 347/19 |
| 6,123,420 | A | 9/2000 | Higuma et al. | 347/86 |
| 6,247,784 | B1 | 6/2001 | Obana et al. | 347/37 |
| 6,250,752 | B1 | 6/2001 | Tajima et al. | 347/92 |
| 6,286,945 | B1 | 9/2001 | Higuma et al. | 347/86 |
| 6,290,344 | B1 | 9/2001 | Saikawa et al. | 347/86 |
| 6,332,673 | B1 | 12/2001 | Higuma et al. | 347/86 |
| 6,382,786 | B2 | 5/2002 | Iwanaga et al. | 347/86 |
| 6,406,118 | B1 | 6/2002 | Aoki et al. | 347/16 |
| 6,419,341 | B1 | 7/2002 | Nohata et al. | 347/19 |
| 6,419,349 | B1 | 7/2002 | Iwanaga et al. | 347/86 |
| 6,474,801 | B2 | 11/2002 | Higuma et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,688,735 | B2 | 2/2004 | Higuma et al. | 347/86 |
| 6,742,881 | B2 | 6/2004 | Kotaki et al. | 347/86 |
| 6,796,643 | B2 | 9/2004 | Higuma et al. | 347/85 |
| 7,156,507 | B2 | 1/2007 | Aruga et al. | 347/85 |
| 7,922,312 | B2 | 4/2011 | Haines et al. | 347/93 |
| 9,315,041 | B2 | 4/2016 | Moriguchi et al. | B41J 2/18 |
| 9,327,513 | B2 | 5/2016 | Moriguchi et al. | B41J 2/175 |
| 9,358,803 | B2 | 6/2016 | Moriguchi et al. | B41J 2/175 |
| 2002/0113853 | A1 | 8/2002 | Hattori et al. | 347/86 |
| 2003/0043241 | A1 | 3/2003 | Hattori et al. | 347/86 |
| 2010/0141722 | A1 * | 6/2010 | Saito | B41J 2/18 347/92 |
| 2012/0256989 | A1 * | 10/2012 | Uezawa | B41J 2/14233 347/54 |
| 2013/0169710 | A1 * | 7/2013 | Keefe | B41J 2/175 347/17 |

OTHER PUBLICATIONS

U.S. Appl. No. 15/387,340 filed Dec. 21, 2016.
U.S. Appl. No. 15/382,039, filed Dec. 16, 2016.
U.S. Appl. No. 15/382,048, filed Dec. 16, 2016.
U.S. Appl. No. 15/380,584, filed Dec. 15, 2016.

* cited by examiner

LIQUID EJECTION APPARATUS AND LIQUID EJECTION HEAD

BACKGROUND OF THE INVENTION

Field of the Invention

The present invention relates to a liquid ejection apparatus, which performs printing by ejecting liquid on a printing medium, represented by an inkjet printing scheme. More specifically, the invention relates to a page wide type liquid ejection head in which a plurality of print element boards is disposed across a page width, and a liquid ejection apparatus mounted with the page wide type liquid ejection head.

Description of the Related Art

There is a known liquid ejection apparatus mounted with a page wide type liquid ejection head in which a plurality of print element boards is disposed across a page width. An elongated liquid ejection head developed for commercial printing is mounted in a liquid ejection apparatus corresponding to an example of the known liquid ejection apparatus. In addition, ink is circulated between an ink tank and a liquid ejection head in a liquid ejection apparatus corresponding to another example thereof.

In such a liquid ejection apparatus, a pressure difference may be generated in a pressure applied to ink adjacent to each ejection opening in some cases. For example, a large amount of ink is supplied to the elongated liquid ejection head, and thus a pressure difference is easily generated around each ejection opening depending on printing duties. In addition, for example, in a circulation-type liquid ejection apparatus, a pressure variation generated when a circulation pump pulses may affect a pressure difference around each ejection opening in some cases.

In a case where printing is performed in a state in which a pressure difference is generated around each ejection opening, the volume of ink drops ejected from each ejection opening is non-uniform, which causes unevenness in density in a printed image to degrade an image quality. In order to avoid this phenomenon, U.S. Pat. No. 7,922,312 and Japanese Patent No. 03606282 have proposed a liquid ejection apparatus in which a pressure adjustment mechanism is provided in an ink supply path that allows communication between an ink tank and a liquid ejection head to adjust a pressure applied to ink adjacent to each ejection opening.

SUMMARY OF THE INVENTION

A liquid ejection apparatus of the invention includes a liquid storage container that stores liquid, a plurality of print element boards including an ejection opening that ejects liquid and a pressure chamber that includes a print element generating energy for ejecting liquid therein, a common supply passage that supplies liquid to the plurality of print element boards, a supply-side filter provided in a passage between the liquid storage container and the common supply passage to remove a foreign substance from liquid, and a supply-side pressure adjustment mechanism provided in a passage at a downstream side of the common supply passage to adjust a pressure in the common supply passage.

Further features of the present invention will become apparent from the following description of exemplary embodiments (with reference to the attached drawings).

DESCRIPTION OF THE EMBODIMENTS

A general liquid ejection apparatus provides a filter, which removes a foreign substance, at an upstream side of an ink supply path from an ink tank to a liquid ejection head, thereby preventing the foreign substance from entering the liquid ejection head.

However, in the liquid ejection apparatus of U.S. Pat. No. 7,922,312 and Japanese Patent No. 03606282, the pressure adjustment mechanism is provided at an upstream side of the liquid ejection head, and a filter is further provided at an upstream side of the pressure adjustment mechanism. For this reason, a foreign substance enters the liquid ejection head due to a foreign substance generated by an opening and closing operation of a valve included in the pressure adjustment mechanism, and some ejection openings are in a non-ejection state in some cases. When printing is performed while some ejection openings continue to be in the non-ejection state, a stripe is formed in a printed image to degrade an image quality. As described above, there has been concern that a conventional liquid ejection apparatus might not be able to print a high-quality image.

Hereinafter, Embodiment 1 of the invention will be described with reference to drawings. A liquid ejection head of the invention which ejects liquid such as ink and a liquid ejection apparatus mounted with the liquid ejection head are applicable to devices such as a printer, a copy machine, a facsimile having a communication system, a word processor having a printer unit, etc. Further, the liquid ejection head and the liquid ejection apparatus are applicable to an industrial print device complexly combined with various processors. Examples of use may include manufacture of a biochip, print of an electronic circuit, manufacture of a semiconductor substrate, etc. In addition, respective embodiments described below are suitable specific examples of the invention, and thus various technically preferable restrictions are imposed thereon. However, the present embodiment is not limited by the respective embodiments of the specification and other specific methods as long as the present embodiment conforms to a technical idea of the invention.

Embodiment 1

(Description of Liquid Ejection Apparatus)

Figure 1:
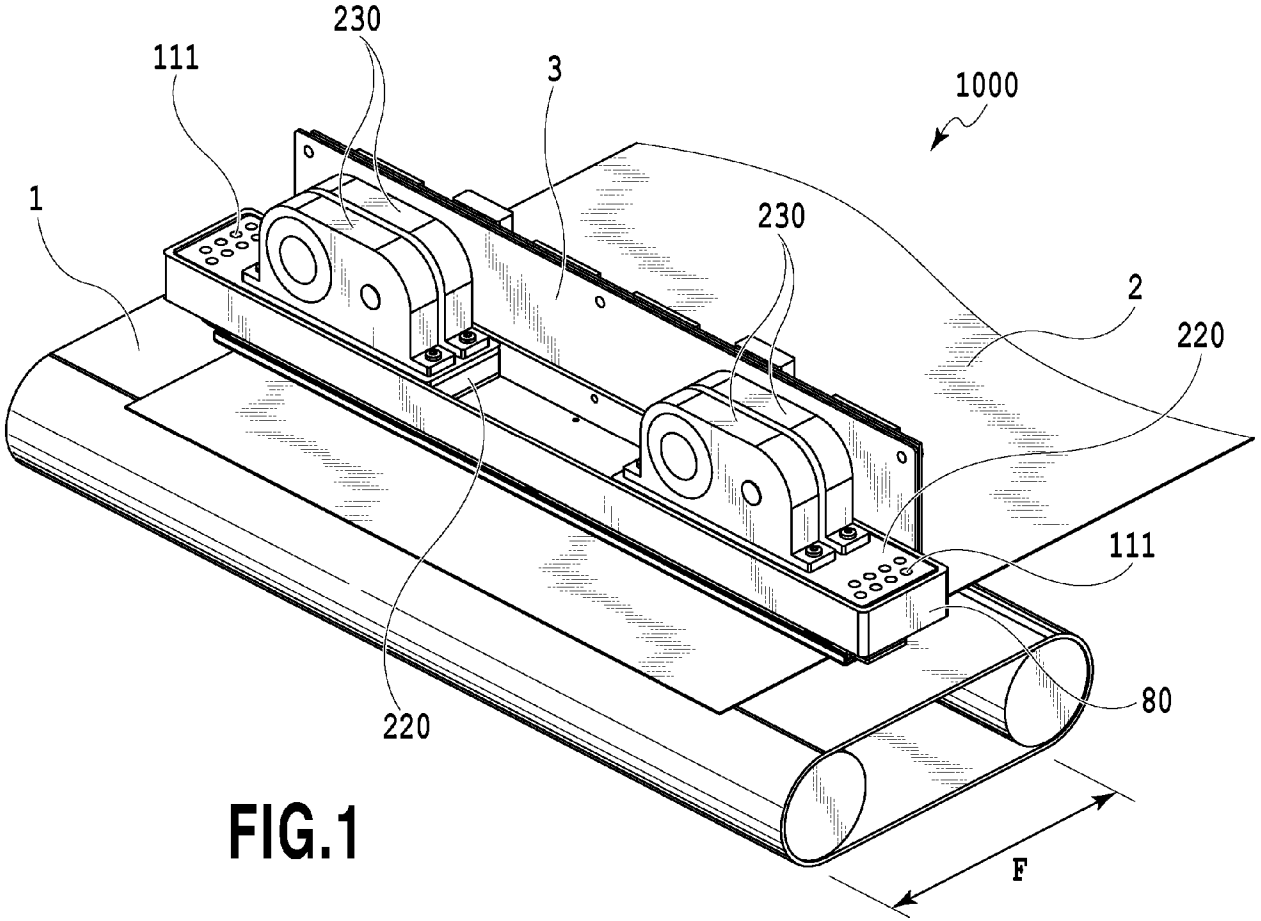
FIG. 1 is a diagram illustrating a schematic configuration of a liquid ejection apparatus that ejects a liquid.

FIG. 1 is a diagram illustrating a schematic configuration of a liquid ejection apparatus that ejects a recording liquid (hereinafter, also referred to as a liquid) in the invention and particularly a liquid ejection apparatus (hereinafter, also referred to as a printing apparatus) 1000 that prints an image by ejecting ink. The liquid ejection apparatus 1000 includes a conveying unit 1 which conveys a print medium 2 and a line type (page wide type) liquid ejection head 3 which is disposed to be substantially orthogonal to the conveying direction of the print medium 2. Then, the liquid ejection apparatus 1000 is a line type printing apparatus which continuously prints an image at one pass by ejecting ink onto the relative moving print mediums 2 while continuously or intermittently conveying the print mediums 2. The liquid ejection head 3 includes a pressure control unit 230 which controls pressures (a negative pressure and a positive pressure) inside a circulation path, a liquid supply unit 220 which communicates with the pressure control unit 230 so that a fluid can flow therebetween, a liquid connection portion 111 which serves as an ink supply opening and an ink discharge opening of the liquid supply unit 220, and a casing 80. The print medium 2 is not limited to a cut sheet and may be also a continuous roll medium. The liquid ejection head 3 can print a full color image by inks of cyan C, magenta M, yellow Y, and black K and is fluid-connected to a liquid supply member, a main tank, and a buffer tank (see FIG. 2 to be described later) which serve as a supply path supplying a liquid to the liquid ejection head 3. Further, the control unit which supplies power and transmits an ejection control signal to the liquid ejection head 3 is electrically connected to the liquid ejection head 3. The liquid path and the electric signal path in the liquid ejection head 3 will be described later.

The liquid ejection apparatus 1000 is an liquid ejection apparatus that circulates a liquid such as ink between a tank to be described later and the liquid ejection head 3. The circulation configuration includes a circulation configuration as a comparative example in which the liquid is circulated by the activation of two circulation pumps (for high and low pressures) at the downstream side of the liquid ejection head 3 and a circulation configuration of the present invention (a first circulation configuration) in which the liquid is circulated by the activation of two circulation pumps (for high and low pressures) at the upstream side of the liquid ejection head 3. Hereinafter, each circulation configuration of the circulation will be described.

(Description of Comparative Example)

Figure 2:
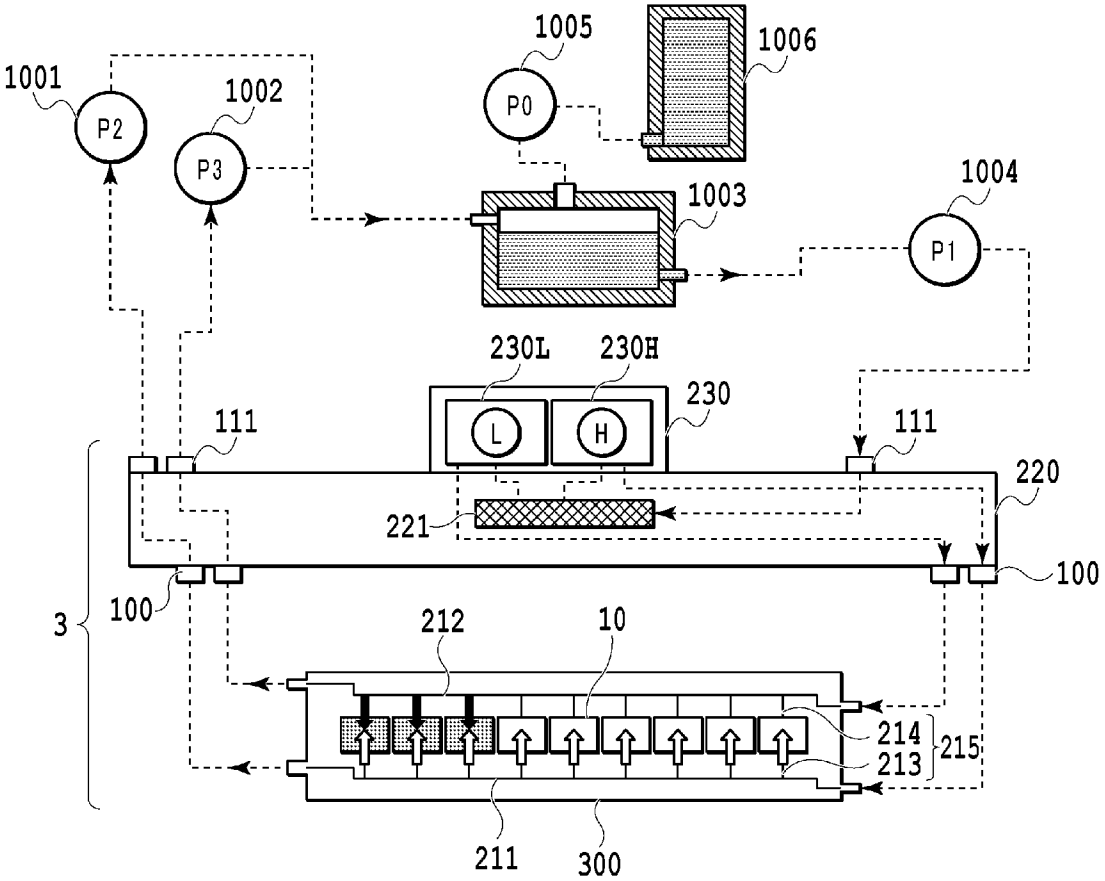
FIG. 2 is a schematic diagram illustrating a circulation configuration as a comparative example in the circulation path applied to the liquid ejection apparatus.

FIG. 2 is a schematic diagram illustrating the circulation configuration as a comparative example in the circulation path applied to the liquid ejection apparatus 1000 of the present embodiment. The liquid ejection head 3 is fluid-connected to a first circulation pump (the high pressure side) 1001, a first circulation pump (the low pressure side) 1002, and a buffer tank 1003. Further, in FIG. 2, in order to simplify a description, a path through which ink of one color of cyan C, magenta M, yellow Y, and black K flows is illustrated. However, in fact, four colors of circulation paths are provided in the liquid ejection head 3 and the liquid ejection apparatus body.

In this circulation configuration, ink stored in the main tank 1006 is supplied to the buffer tank 1003 by a replenishing pump 1005, and then supplied to the liquid supply unit 220 of the liquid ejection head 3 through the liquid connection portion 111 by a second circulation pump 1004. In the present embodiment, the main tank 1006 and the buffer tank 1003 correspond to a liquid storage container that stores a print liquid. Thereafter, ink adjusted to two different pressures (high pressure and low pressure) by the pressure control unit 230 connected to the liquid supply unit 220 circulates by being divided into two passages on the high pressure side and the low pressure side. In the present embodiment, a description will be given of a mode in which the pressure control unit 230 controls two different negative pressures. However, in a modified example described below, a description will be given of a mode in which the pressure control unit 230 controls a positive pressure and a negative pressure. Ink inside the liquid ejection head 3 circulates inside the liquid ejection head by actions of the first circulation pump (high pressure side) 1001 and the first circulation pump (low pressure side) 1002 in a downstream side of the liquid ejection head 3, and returns to the buffer tank 1003 by being discharged from the liquid ejection head 3.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality. Above all, when a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The pressure control unit 230 is provided in a path between the second circulation pump 1004 and the liquid ejection unit 300. The pressure control unit 230 is operated to keep a pressure at the downstream side (that is, a pressure near the liquid ejection unit 300) of the pressure control unit 230 at a predetermined pressure even when the flow rate of the ink changes in the circulation system due to a difference in ejection amount per unit area. As two pressure control mechanisms constituting the pressure control unit 230, any mechanism may be used as long as a pressure at the downstream side of the pressure control unit 230 can be controlled within a predetermined range or less from a desired set pressure. As an example, a mechanism such as so-called "a pressure reduction valve and a pressure reduction regulator" can be employed. In the circulation passage of the application example, the upstream side of the pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the liquid ejection apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the pressure control unit 230 can be also used instead of the second circulation pump 1004. As illustrated in FIG. 2, the pressure control unit 230 includes two pressure adjustment mechanisms respectively having different control pressures. In the two pressure adjustment mechanisms, a relatively high pressure side (indicated by "H" in FIG. 2) and a relatively low pressure side (indicated by "L" in FIG. 2) are respectively connected to the common supply passage 211 and the common collection passage 212 inside the liquid ejection unit 300 through the liquid supply unit 220. The liquid ejection unit 300 is provided with the common supply passage 211, the common collection passage 212, and an individual passage 215 (an individual supply passage 213 and an individual collection passage 214) communicating with each print element board. The pressure adjustment mechanism H is connected to the common supply passage 211, the pressure adjustment mechanism L is connected to the common collection passage 212, and a differential pressure is formed between the two common passages. Then, the individual passage 215 is connected to the common supply passage 211 corresponding to one of a pair of common passages and the common collection passage 212 corresponding to the other one of the pair of common passages, and communicates with an ejection opening 13 of the print element board 10. According to this configuration, a flow (an arrow direction of FIG. 2) is generated in which a part of the liquid flows from the common supply passage 211 to the common collection passage 212 through a passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign substance in the ink can be discharged toward the common collection passage 212. For this reason, the liquid ejection head 3 of the application example can print a high-quality image at a high speed.

(Description of First Circulation Configuration)

Figure 3:
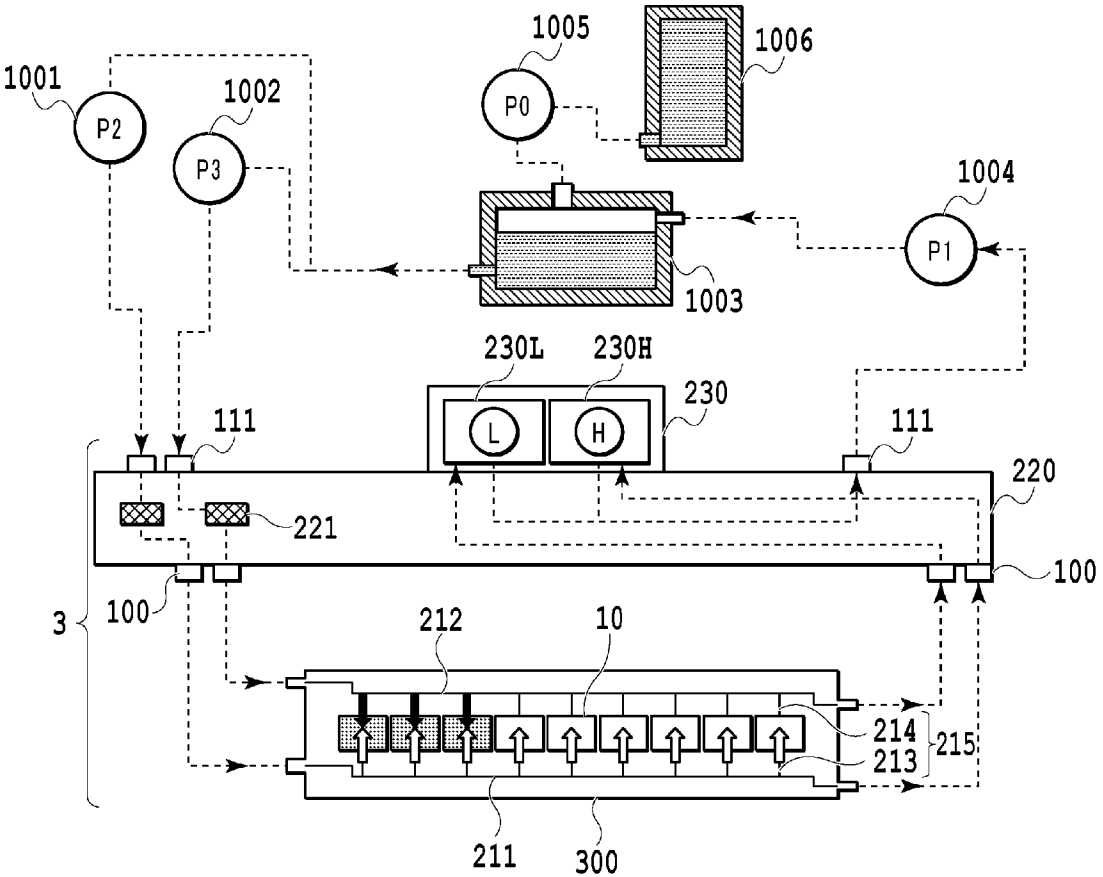
FIG. 3 is a schematic diagram illustrating a first circulation configuration in the circulation path applied to the liquid ejection apparatus.

FIG. 3 is a schematic diagram illustrating the first circulation configuration which is a circulation configuration different from the circulation configuration described above in the circulation path applied to the liquid ejection apparatus of the application example. A main difference from the circulation configuration described above is that two pressure control mechanisms constituting the pressure control unit 230 both control a pressure at the upstream side of the pressure control unit 230 within a predetermined range from a desired set pressure. Further, another difference from the circulation configuration in FIG. 2 is that the second circulation pump 1004 serves as a negative pressure source which reduces a pressure at the downstream side of the pressure control unit 230. Further, still another difference is that the first circulation pump (the high pressure side) 1001 and the first circulation pump (the low pressure side) 1002 are disposed at the upstream side of the liquid ejection head 3 and the pressure control unit 230 is disposed at the downstream side of the liquid ejection head 3.

In the first circulation configuration, the ink inside the main tank 1006 is supplied to the buffer tank 1003 by the replenishing pump 1005. Subsequently, the ink is divided into two passages and is circulated in two passages at the high pressure side and the low pressure side by the action of the pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the pressure control unit 230. The discharged ink is returned to the buffer tank 1003 by the second circulation pump 1004.

In the first circulation configuration, the pressure control unit 230 stabilizes a pressure variation at an upstream side (that is, the liquid ejection unit 300 side) of the pressure control unit 230 within a certain range around a preset pressure even when the flow rate changes due to a change in ejection amount per unit area. As the two pressure adjustment mechanism included in the pressure control unit 230, any pressure adjustment mechanism may be used as long as a pressure at the upstream side of the pressure control unit 230 can be controlled to change within a certain range or less from a desired control pressure. As an example, a back pressure-type pressure adjustment valve mechanism referred to as a so-called "back pressure valve/back pressure regulator" can be employed. In the circulation passage of the present embodiment, a downstream side of the pressure control unit 230 is pressurized by the second circulation pump 1004 through the liquid supply unit 220. With such a configuration, since an influence of a water head pressure of the buffer tank 1003 on the liquid ejection head 3 can be suppressed, a range of selection of layout of the buffer tank 1003 in the liquid ejection apparatus 1000 can be widened. For example, a water head tank disposed to have a certain water head difference with respect to the pressure control unit 230 can be also used instead of the second circulation pump 1004. The pressure control unit 230 includes two pressure adjustment mechanisms respectively having different control pressures. In the two pressure adjustment mechanisms, a high pressure side (indicated by "230H" in FIG. 3) and a low pressure side (indicated by "230L" in FIG. 3) are respectively connected to the common supply passage 211 and the common collection passage 212 inside the liquid ejection unit 300 through the liquid supply unit 220. When a pressure in the common supply passage 211 is set to be relatively higher than a pressure in the common collection passage 212 using the two pressure adjustment mechanisms, an ink flow is generated to flow from the common supply passage 211 to the common collection passage 212 through the individual passage 215 and the passage formed inside each print element board 10.

In such a first circulation configuration, the same ink flow as that in the circulation configuration in FIG. 2 is obtained inside the liquid ejection unit 300, but has two advantages different from those in the circulation configuration in FIG. 2. As a first advantage, a foreign substance or a trash entering the pressure control unit 230 is prevented from flowing into the liquid ejection head 3. In other words, in the first circulation configuration, the pressure control unit 230 is disposed at the downstream side of the liquid ejection head 3, and a filter 221 described below is disposed at the upstream side of the liquid ejection head 3. For this reason, the foreign substance entering the pressure control unit 230 may be removed from the liquid and prevented from flowing into the liquid ejection head 3 when ink is circulated in the circulation path by operating the first circulation pumps 1001 and 1002 and the second circulation pump 1004. In first circulation configuration, a pressure adjustment unit is disposed at the downstream side of the liquid ejection head 3. Therefore, even when a foreign substance enters the circulation path by opening and closing a valve included in the pressure adjustment mechanism, the entering foreign substance is removed by the filter 221 before arriving at the liquid ejection head 3. As a second advantage, in the first circulation configuration, a maximal value of a necessary rate of a flow supplied from the liquid from the buffer tank 1003 to the liquid ejection head 3 is smaller than that in the circulation configuration in FIG. 2. The reason is as below.

In the case of the circulation in the print standby state, the sum of the flow rates of the common supply passage 211, the common collection passage 212 and individual passages 215 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening×the ejection frequency per unit time×the number of the ejection openings).

Figure 4:
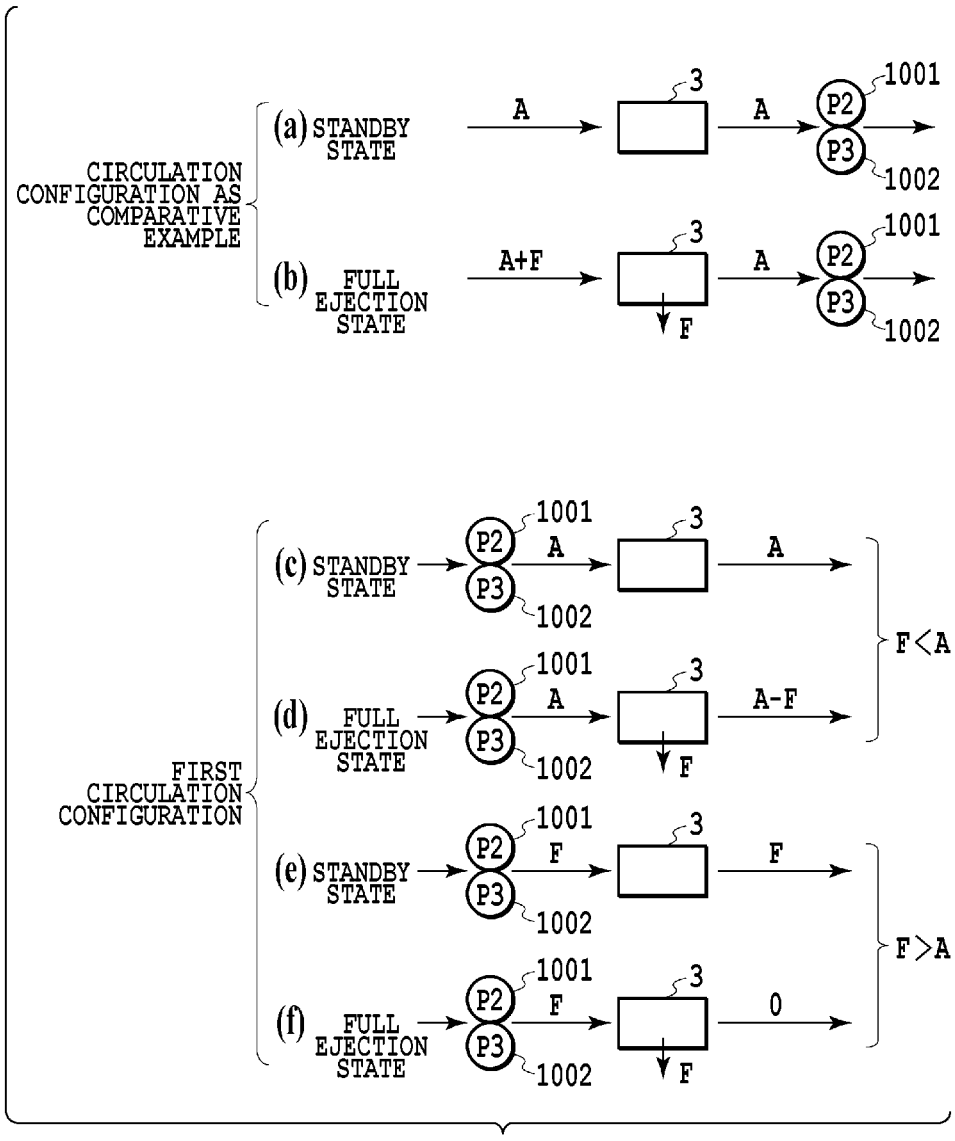
FIG. 4 is a schematic diagram illustrating a difference in ink inflow amount to a liquid ejection head.

FIG. 4 is a schematic diagram illustrating a difference in ink inflow amount to the liquid ejection head 3 between the circulation configuration described in FIG. 2 and the first circulation configuration. A reference character (a) illustrates the standby state in the circulation configuration described in FIG. 2 and a reference character (b) illustrates the full ejection state in the circulation configuration described in FIG. 2. Reference characters (c) to (f) illustrate the first circulation passage. Here, reference characters (c) and (d) illustrate a case where the flow rate F is lower than the flow rate A and reference characters (e) and (f) illustrate a case where the flow rate F is higher than the flow rate A. In this way, the flow rates in the standby state and the full ejection state are illustrated.

In the case of the circulation configuration in FIG. 2 (reference characters (a) and (b)) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes a flow rate A. By the flow rate A, the temperature inside the liquid ejection unit 300 in the standby state can be managed. In addition, in the case of the full ejection state of the liquid ejection head 3, the total flow rate of the first circulation pump 1001 and the first circulation pump 1002 is the flow rate A as before. However, a negative pressure generated by ejection in the liquid ejection head 3 acts. For this reason, a maximal rate of the flow supplied to the liquid ejection head 3 is obtained such that a flow rate F consumed by the full ejection is added to the flow rate A of the total flow rate. Therefore, a maximal value of the supply amount to the liquid ejection head 3 satisfies a relation of the flow rate A+the flow rate F since the flow rate F is added to the flow rate A (the reference character (b)).

Herein, the case of the full ejection state is considered in which some print element boards 10 among a plurality of print element boards 10 are in a print standby state, and ink is ejected from all ejection openings 13 of the other print element boards 10 in the circulation configuration in FIG. 2. The liquid ejection apparatus 1000 of the present embodiment is configured such that ink is supplied to the print element boards 10 in the print standby state. A description will be given on the assumption that print element boards 10 indicated by halftone dot meshing among the print element boards 10 of the liquid ejection unit 300 correspond to print element boards 10 in the full ejection state, and print element boards 10 indicated by white space among the print element boards 10 correspond to print element boards 10 in the print standby state as illustrated in FIG. 2. In this instance, in addition to ink from the common supply passage 211 (a direction of a void arrow), a certain amount of ink from the common collection passage 212 (a direction of a black arrow) is supplied to the print element boards 10 in the full ejection state. Meanwhile, ink from the common supply passage 211 (a direction of a void arrow) is continuously supplied to the print element boards 10 in the print standby state. Since the amount of ink flowing into the liquid ejection unit 300 increases, a differential pressure between the common supply passage 211 and the common collection passage 212 slightly varies. However, an influence thereof may be ignored when a cross-sectional area of the common passage may be sufficiently ensured.

As described above, the circulation configuration in FIG. 2 of the present embodiment has a configuration in which ink is supplied to the print element boards 10 in the print standby state when some print element boards 10 are in the print standby state, and the other print element boards 10 are in the full ejection state. According to this configuration, the amount of ink supplied to the liquid ejection head 3 may be suitably controlled. In other words, the differential pressure between the common passages may be controlled such that a flow rate of ink passing through individual passages 215 in the print element boards 10 in the print standby state is smaller than an ejection flow rate of ink ejected from all ejection openings 13 in the print element boards 10. When the differential pressure between the common supply passage 211 and the common collection passage 212 is controlled as described above, the amount of ink circulated in the print element boards 10 in the print standby state may be suppressed irrespective of a variation in ejection flow rate of ink from the ejection openings 13 of the liquid ejection head 3. When the amount of ink circulated in the print element boards 10 in the print standby state may be suppressed, exhaust heat from the liquid ejection head 3 may be suppressed, and a cooling mechanism, etc. for cooling ink inside the circulation passage may be simplified.

Meanwhile, in the case of the first circulation configuration (reference characters (c) to (f)) in which the first circulation pump 1001 and the first circulation pump 1002 are disposed at the upstream side of the liquid ejection head 3, the supply amount to the liquid ejection head 3 necessary for the print standby state becomes the flow rate A similarly to the circulation configuration in FIG. 2. Thus, when the flow rate A is higher than the flow rate F (reference characters (c) and (d)) in the first circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (a reference character (d)). However, when the flow rate F is higher than the flow rate A (reference characters (e) and (f)), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (the reference character (f)). In addition, if the liquid is not ejected in the full ejection state when the flow rate F is higher than the flow rate A, the liquid which is attracted by the amount consumed by the ejection of the flow rate F is discharged from the liquid ejection head 3.

As described above, in the case of the first circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the first circulation configuration becomes smaller than the maximal value (the flow rate A+the flow rate F) of the supply flow rate necessary for the circulation configuration described in FIG. 2. The first circulation configuration of the present embodiment is configured such that, when some print element boards 10 are in the print standby state, and the other print element boards 10 are in the full ejection state, ink is supplied to the print element boards 10 in the print standby state. The first circulation configuration is similar to the circulation configuration described in FIG. 2 in that the amount of ink circulated in the print element boards 10 in the print standby state is suppressed irrespective of a variation in ejection flow rate of ink from the ejection openings 13 of the liquid ejection head 3 by controlling the differential pressure between the common supply passage 211 and the common collection passage 212.

For that reason, in the case of the first circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a long longitudinal length among the line heads is beneficial.

(Description of Configuration of Liquid Ejection Head)

Figure 5A:
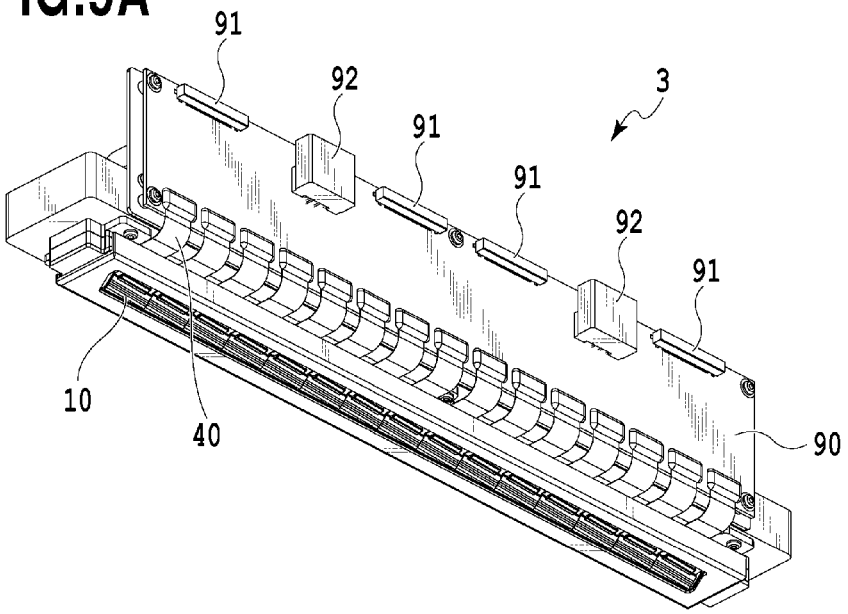
FIG. 5A is a perspective view illustrating the liquid ejection head.
Figure 5B:
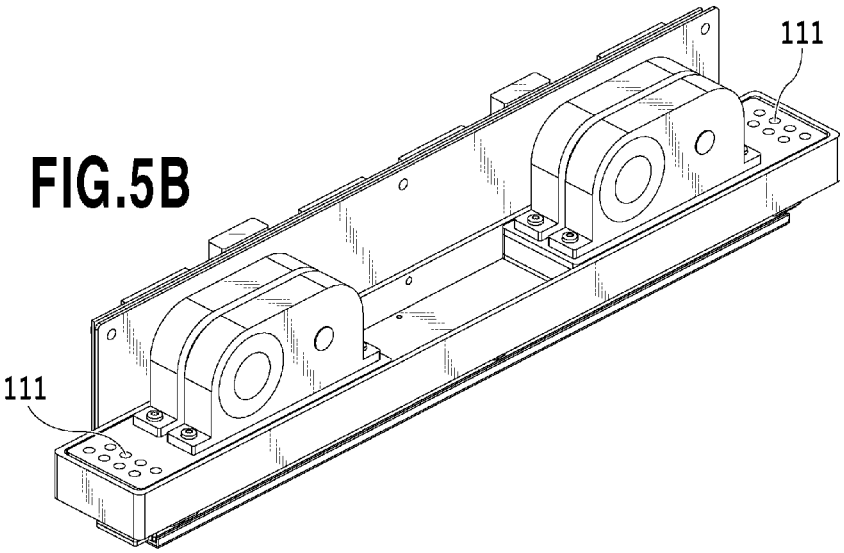
FIG. 5B is a perspective view illustrating the liquid ejection head.

A configuration of the liquid ejection head 3 according to the first embodiment will be described. FIGS. 5A and 5B are perspective views illustrating the liquid ejection head 3 according to the present embodiment. The liquid ejection head 3 is a page wide type liquid ejection head in which fifteen print element boards 10 capable of ejecting inks of four colors of cyan C, magenta M, yellow Y, and black K are arranged in a straight line shape on one print element board 10 (an in-line arrangement). As illustrated in FIG. 5A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10. The signal input terminal 91 and the power supply terminal 92 are electrically connected to the control unit of the liquid ejection apparatus 1000 so that an ejection drive signal and power necessary for the ejection are supplied to the print element board 10. When the wirings are integrated by the electric circuit inside the electric wiring board 90, the number of the signal input terminals 91 and the power supply terminals 92 can be decreased compared with the number of the print element boards 10. Accordingly, the number of electrical connection components to be separated when the liquid ejection head 3 is assembled to the liquid ejection apparatus 1000 or the liquid ejection head is replaced decreases. As illustrated in FIG. 5B, the liquid connection portions 111 which are provided at both ends of the liquid ejection head 3 are connected to the liquid supply system of the liquid ejection apparatus 1000. Accordingly, the inks of four colors including cyan C, magenta M, yellow Y, and black K4 are supplied from the supply system of the liquid ejection apparatus 1000 to the liquid ejection head 3 and the inks passing through the liquid ejection head 3 are collected by the supply system of the liquid ejection apparatus 1000. In this way, the inks of different colors can be circulated through the path of the liquid ejection apparatus 1000 and the path of the liquid ejection head 3.

Figure 6:
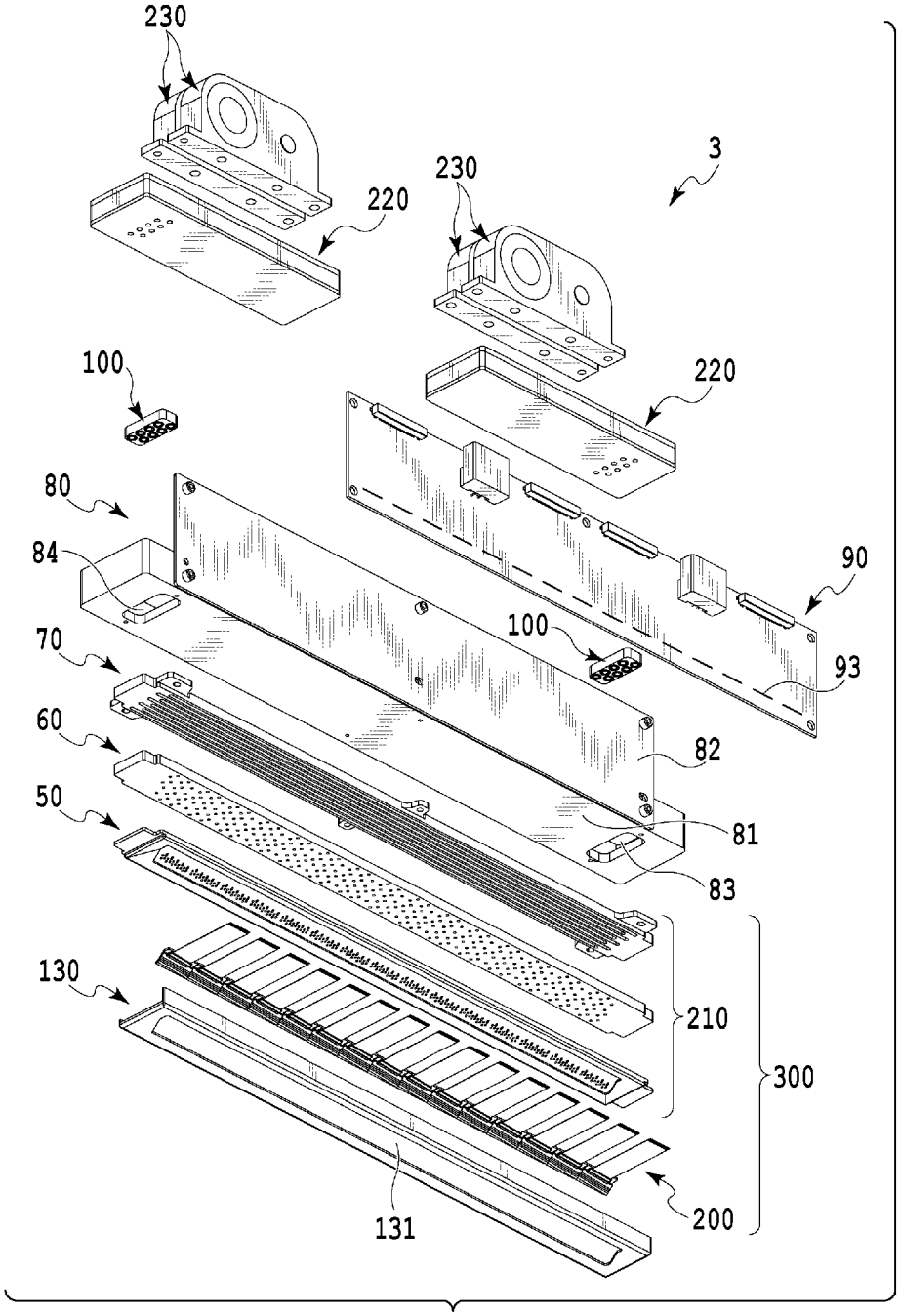
FIG. 6 is an exploded perspective view of the liquid ejection head.

FIG. 6 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 3) are provided in the liquid supply unit 220. Also, in order to remove a foreign substance in the supplied ink, filters 221 (see FIGS. 2 and 3) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the pressure control unit 230 disposed on the liquid supply unit 220 disposed to correspond to each color. The pressure control unit 230 is a unit which includes different colors of pressure control valves. By the function of a spring member or a valve provided therein, a change in pressure loss inside the supply system (the supply system at the upstream side of the liquid ejection head 3) of the liquid ejecting apparatus 1000 caused by a change in flow rate of the liquid is largely decreased. Accordingly, the pressure control unit 230 can stabilize a change negative pressure at the downstream side (the liquid ejection unit 300) of the pressure control unit within a predetermined range. As described in FIG. 2, two pressure control valves of different colors are built inside the pressure control unit 230. Two pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed. For that reason, it is desirable that the liquid ejection unit support portion 81 have sufficient rigidity. As a material, metal such as SUS or aluminum or ceramic such as alumina is desirable. The liquid ejection unit support portion 81 is provided with openings 83 and 84 into which a joint rubber 100 is inserted. The liquid supplied from the liquid supply unit 220 is led to a third passage member 70 constituting the liquid ejection unit 300 through the joint rubber.

The liquid ejection unit 300 includes a plurality of ejection modules 200 and a passage member 210 and a cover member 130 is attached to a face near the print medium in the liquid ejection unit 300. Here, the cover member 130 is a member having a picture frame shaped surface and provided with an elongated opening 131 as illustrated in FIG. 6 and the print element board 10 and a sealing member 110 (see FIG. 10A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 6, the passage member 210 is obtained by laminating a first passage member 50, a second passage member 60, and a third passage member 70 and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus the warpage or deformation of the passage member 210 is suppressed.

Figure 7:
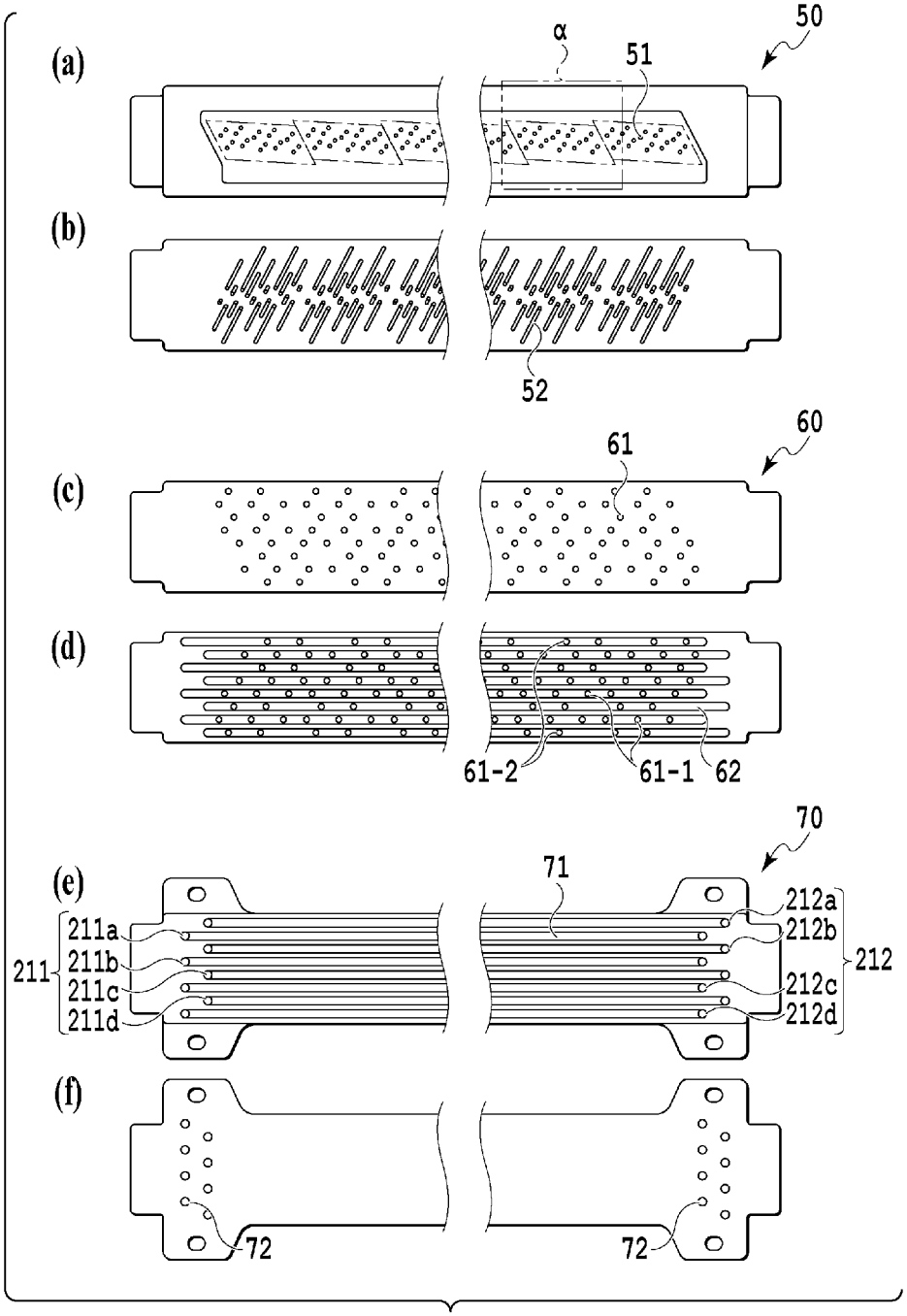
FIG. 7 is a diagram illustrating front and rear faces of first to third passage members.

FIG. 7 is a diagram illustrating front and rear faces of the first to third passage members. A reference character (a) illustrates a face onto which the ejection module 200 is mounted in the first passage member 50 and a reference character (f) illustrates a face with which the liquid ejection unit support portion 81 comes into contact in the third passage member 70. The first passage member 50 and the second passage member 60 are bonded to teach other so that the parts illustrated in reference characters (b) and (c) and corresponding to the contact faces of the passage members face each other and the second passage member and the third passage member are bonded to each other so that the parts illustrated in reference characters (d) and (e) corresponding to the contact faces of the passage members face each other. When the second passage member 60 and the third passage member 70 are bonded to each other, eight common passages (211*a*, 211*b*, 211*c*, 211*d*, 212*a*, 212*b*, 212*c*, 212*d*) extending in the longitudinal direction of the passage member are formed by common passage grooves 62 and 71 of the passage members. Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see the reference character (f)) of the third passage member 70 communicates with the holes of the joint rubber 100 and is fluid-connected to the liquid supply unit 220 (see FIG. 6). A bottom face of the common passage groove 62 of the second passage member 60 is provided with a plurality of communication openings 61 (a communication opening 61-1 communicating with the common supply passage 211 and a communication opening 61-2 communicating with the common collection passage 212) and communicates with one end of an individual passage groove 52 of the first passage member 50. The other end of the individual passage groove 52 of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 8:
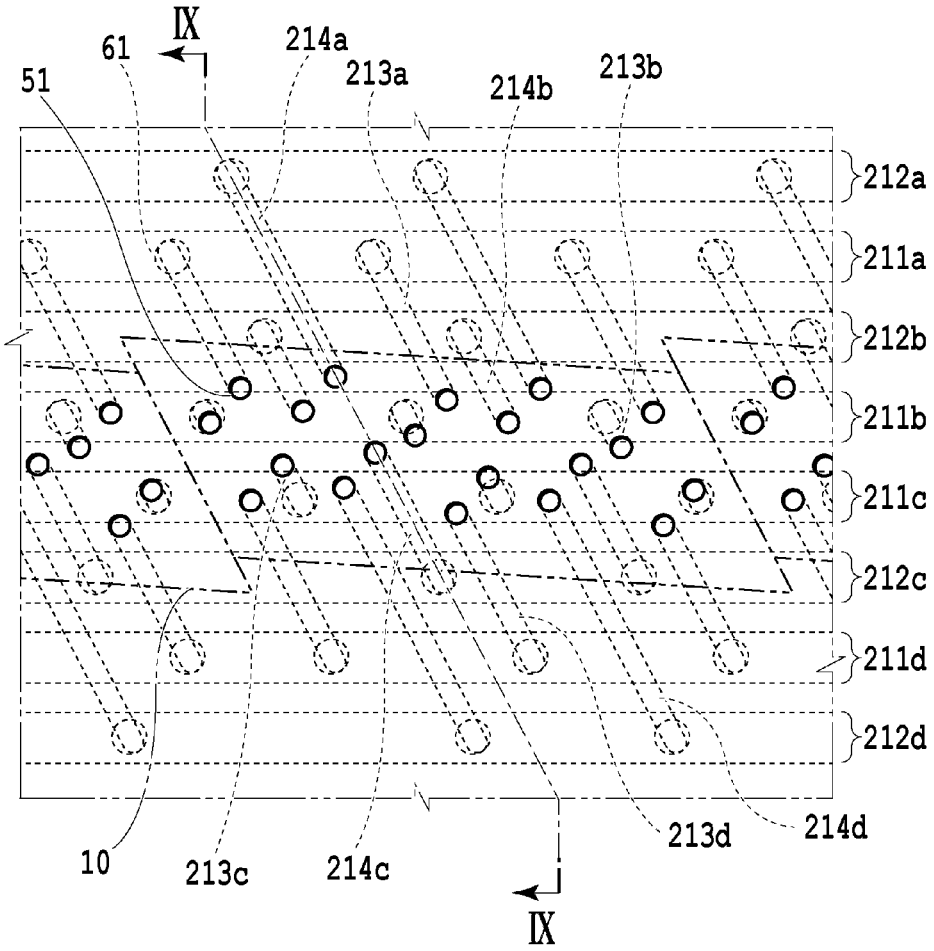
FIG. 8 is a perspective view of a part α of a reference character (a) in FIG. 7 when viewed from an ejection module mounting face.

FIG. 8 is a partially enlarged perspective view illustrating a part α of a reference character (a) and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 of different colors through the communication openings 61. Further, the individual collection passages 214 (214*a*, 214*b*, 214*c*, 214*d*) formed by the individual passage grooves 52 are connected to the common collection passages 212 of different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 9:
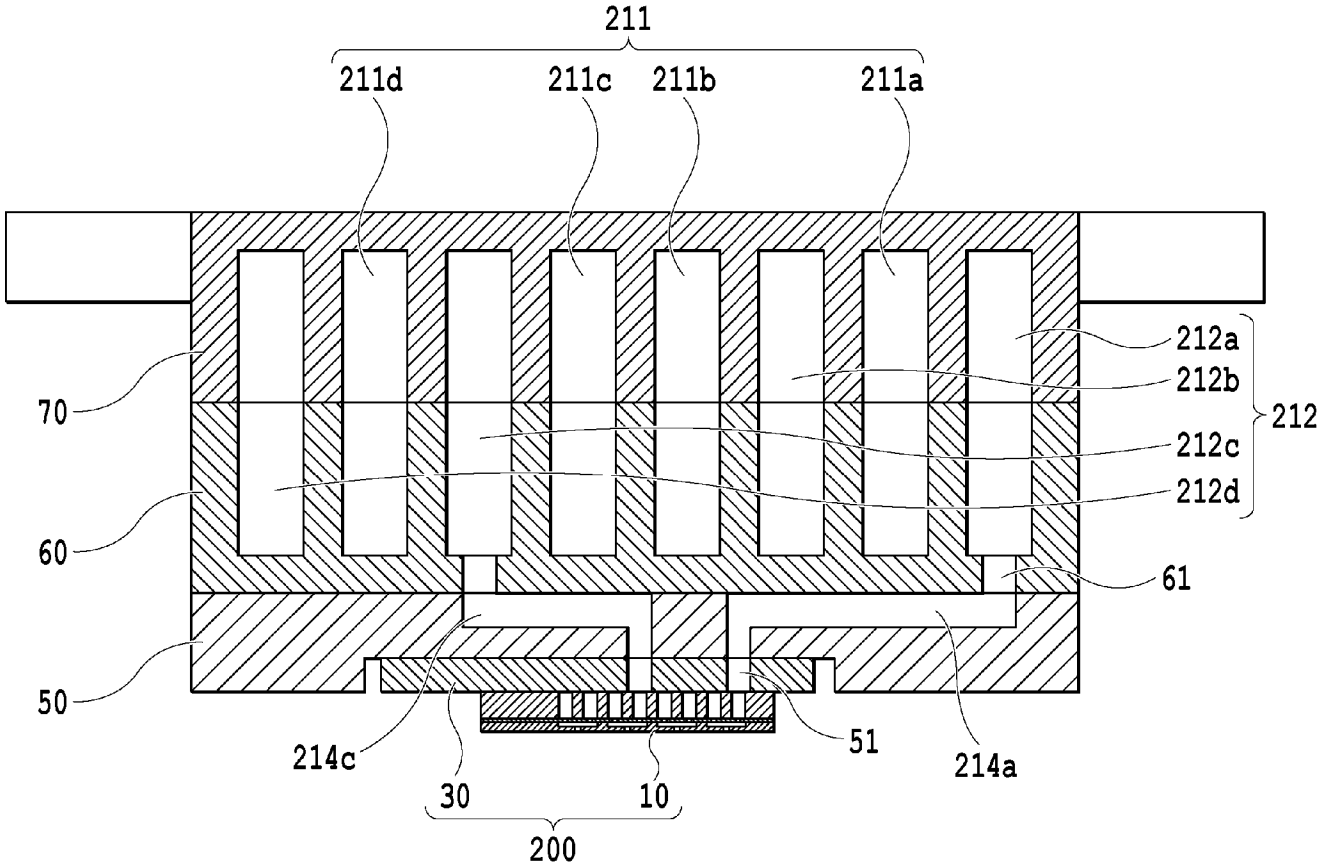
FIG. 9 is a cross-sectional view taken along a line IX-IX of FIG. 8.

FIG. 9 is a cross-sectional view taken along a line IX-IX of FIG. 8. The individual collection passage (214*a*, 214*c*) communicates with the ejection module 200 through the communication opening 51. In FIG. 9, only the individual collection passage (214*a*, 214*c*) is illustrated, but in a different cross-section, the individual supply passage 213 and the ejection module 200 communicates with each other as illustrated in FIG. 8. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the pressure control unit 230 (the high pressure side) of corresponding color through the liquid supply unit 220 and the common collection passage 212 is connected to the pressure control unit 230 (the low pressure side) through the liquid supply unit 220. By the pressure control unit 230, a differential pressure (a difference in pressure) is generated between the common supply passage 211 and the common collection passage 212. For this reason, as illustrated in FIGS. 8 and 9, a flow is generated in order of the common supply passage 211 of each color, the individual supply passage 213, the print element board 10, the individual collection passage 214, and the common collection passage 212 inside the liquid ejection head of the application example having the passages connected to one another.

(Description of Ejection Module)

Figure 10A:
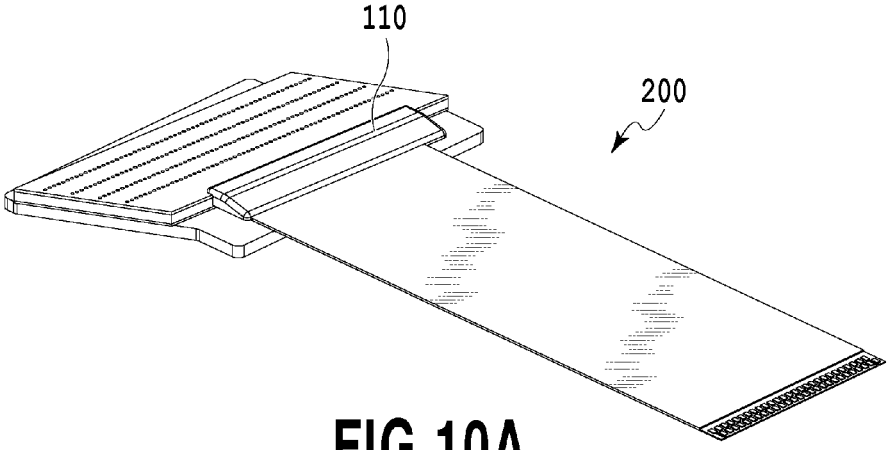
FIG. 10A is a perspective view illustrating one ejection module.
Figure 10B:
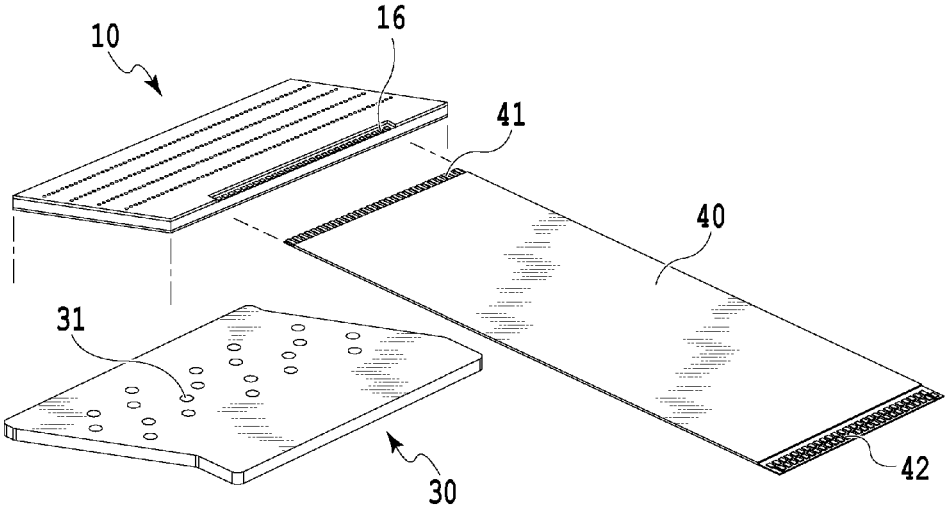
FIG. 10B is an exploded view illustrating one ejection module.

FIG. 10A is a perspective view illustrating one ejection module 200 and FIG. 10B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110. A terminal 42 which is opposite to the print element board 10 of the flexible circuit board 40 is electrically connected to a connection terminal 93 (see FIG. 6) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 11A:
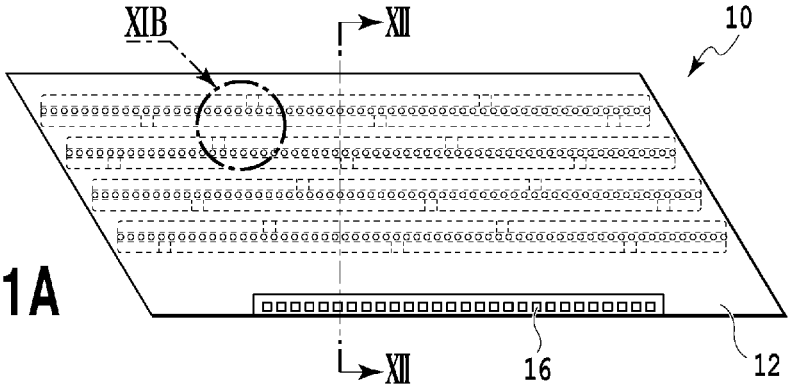
FIG. 11A is a diagram illustrating a print element board.
Figure 11B:
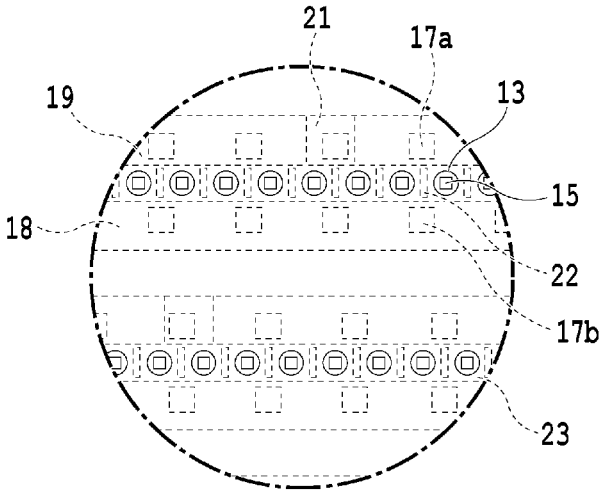
FIG. 11B is a diagram illustrating the print element board.
Figure 11C:
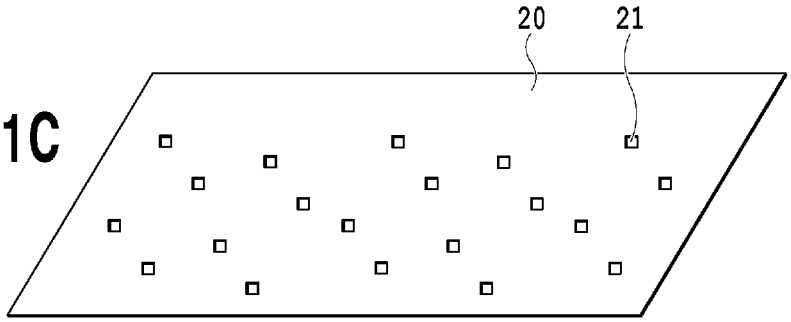
FIG. 11C is a diagram illustrating the print element board.

FIG. 11A is a top view illustrating a face provided with an ejection opening 13 in the print element board 10, FIG. 11B is an enlarged view of a part XIB of FIG. 11A, and FIG. 11C is a top view illustrating a rear face of FIG. 11A. Here, a configuration of the print element board 10 of the application example will be described. As illustrated in FIG. 11A, an ejection opening forming member 12 of the print element board 10 is provided with four ejection opening rows corresponding to different colors of inks. Further, the extension direction of the ejection opening rows of the ejection openings 13 will be referred to as an "ejection opening row direction". As illustrated in FIG. 11B, the print element 15 serving as an ejection energy generation element for ejecting the liquid by heat energy is disposed at a position corresponding to each ejection opening 13. A pressure chamber 23 provided inside the print element 15 is defined by a partition wall 22. The print element 15 is electrically connected to the terminal 16 by an electric wire (not illustrated) provided in the print element board 10. Then, the print element 15 boils the liquid while being heated on the basis of a pulse signal input from a control circuit of the liquid ejection apparatus 1000 via the electric wiring board 90 (see FIG. 6) and the flexible circuit board 40 (see FIG. 10B). The liquid is ejected from the ejection opening 13 by a foaming force caused by the boiling. As illustrated in FIG. 11B, a liquid supply path 18 extends at one side along each ejection opening row and a liquid collection path 19 extends at the other side along the ejection opening row. The liquid supply path 18 and the liquid collection path 19 are passages that extend in the ejection opening row direction provided in the print element board 10 and communicate with the ejection opening 13 through a supply opening 17*a* and a collection opening 17*b*.

As illustrated in FIG. 11C, a sheet-shaped lid member 20 is laminated on a rear face of a face provided with the ejection opening 13 in the print element board 10 and the lid member 20 is provided with a plurality of openings 21 communicating with the liquid supply path 18 and the liquid collection path 19. In the application example, the lid member 20 is provided with three openings 21 for each liquid supply path 18 and two openings 21 for each liquid collection path 19. As illustrated in FIG. 11B, openings 21 of the lid member 20 communicate with the communication openings 51 illustrated in the reference character (a). It is desirable that the lid member 20 have sufficient corrosion resistance for the liquid. From the viewpoint of preventing mixed color, the opening shape and the opening position of the opening 21 need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member by a film-shaped member with a thin thickness in consideration of pressure loss.

Figure 12:
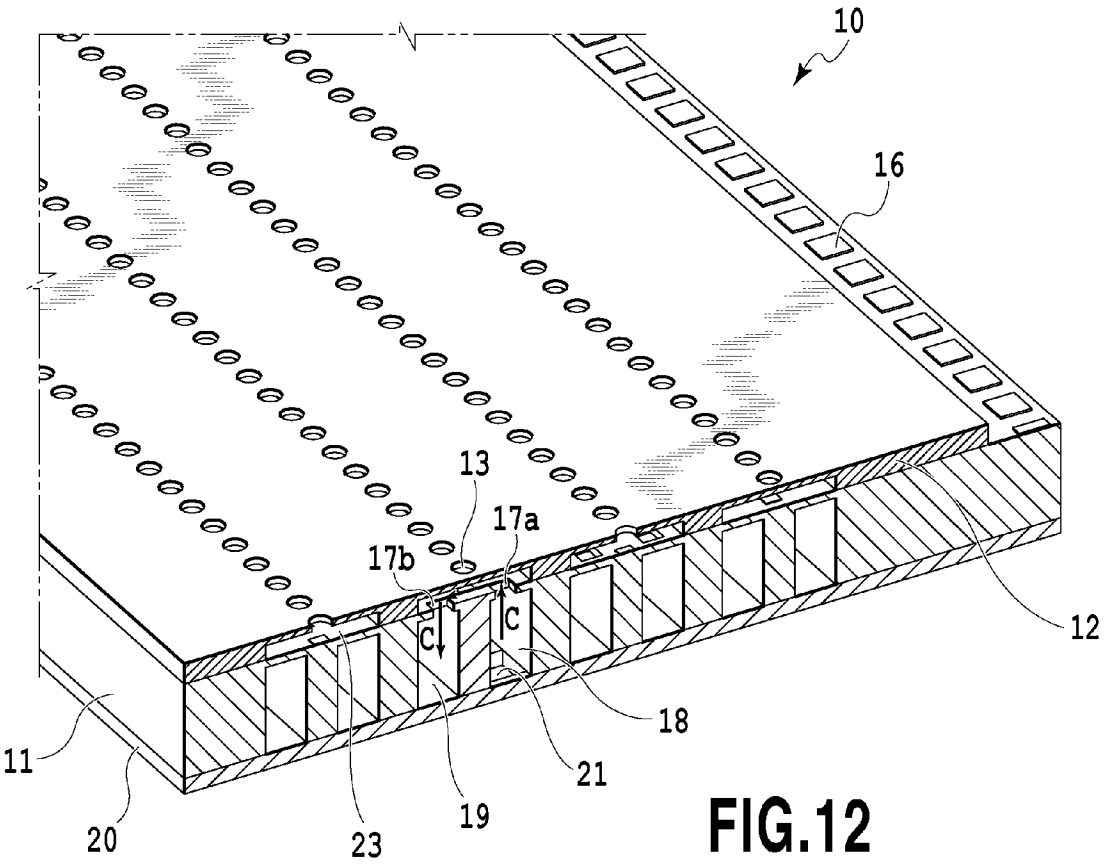
FIG. 12 is a perspective view illustrating cross-sections of the print element board and a lid member.

FIG. 12 is a perspective view illustrating cross-sections of the print element board 10 and the lid member 20 when taken along a line XII-XII of FIG. 11A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11. One face of the substrate 11 is provided with the print element 15 (see FIG. 11B) and a rear face thereof is provided with grooves forming the liquid supply path 18 and the liquid collection path 19 extending along the ejection opening row. The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 12). By the flow, foreign substances, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed. The liquid which is collected to the liquid collection path 19 is collected in order of the communication opening 51 inside the passage member 210, the individual collection passage 214, and the common collection passage 212 through the opening 21 of the lid member 20 and the liquid communication opening 31 (see FIG. 10B) of the support member 30. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11. In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening 51 and the individual passage groove 52 provided in the first passage member, the communication opening 61 and the common passage groove 62 provided in the second passage member, the common passage groove 71 and the communication opening 72 provided in the third passage member 70, and the joint rubber 100. Then, the liquid flows from the liquid connection portion 111 provided in the liquid supply unit 220 to the outside of the liquid ejection head 3.

In the circulation configuration as a comparative example illustrated in FIG. 2, the liquid which flows from the liquid connection portion 111 is supplied to the joint rubber 100 through the pressure control unit 230. Further, in the first circulation configuration illustrated in FIG. 3, the liquid which is collected from the pressure chamber 23 passes through the joint rubber 100 and flows from the liquid connection portion 111 to the outside of the liquid ejection head through the pressure control unit 230. The entire liquid which flows from one end of the common supply passage 211 of the liquid ejection unit 300 is not supplied to the pressure chamber 23 through the individual supply passage 213. That is, the liquid may flow from the other end of the common supply passage 211 to the liquid supply unit 220 while not flowing into the individual supply passage 213 by the liquid which flows from one end of the common supply passage 211. In this way, since the path is provided so that the liquid flows therethrough without passing through the print element board 10, the reverse flow of the circulation flow of the liquid can be suppressed even in the print element board 10 including the large passage with a small flow resistance as in the application example. In this way, since the thickening of the liquid in the vicinity of the ejection opening or the pressure chamber 23 can be suppressed in the liquid ejection head 3 of the application example, a slippage or a non-ejection can be suppressed. As a result, a high-quality image can be printed.

Figure 13:
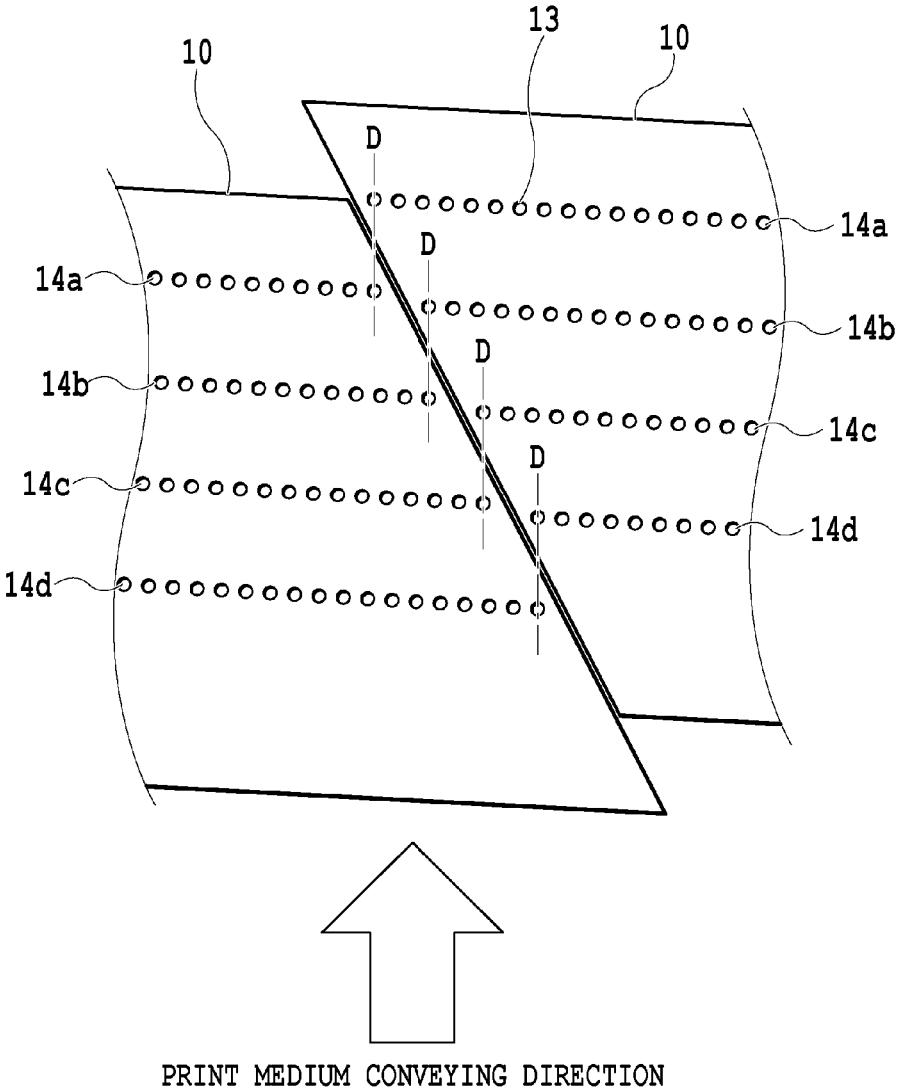
FIG. 13 is a partially enlarged top view of an adjacent portion of the print element board.

FIG. 13 is a partially enlarged top view illustrating an adjacent portion of the print element board in two adjacent ejection modules. In the application example, a substantially parallelogram print element board is used. Ejection opening rows (14*a* to 14*d*) having the ejection openings 13 arranged in each print element board 10 are disposed to be inclined while having a predetermined angle with respect to the longitudinal direction of the liquid ejection head 3. Then, the ejection opening row at the adjacent portion between the print element boards 10 is formed such that at least one ejection opening overlaps in the print medium conveying direction. In FIG. 13, two ejection openings on a line D overlap each other. With such an arrangement, even when a position of the print element board 10 is slightly deviated from a predetermined position, black streaks or missing of a print image cannot be seen by a driving control of the overlapping ejection openings. Even when the print element boards 10 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 13. Further, in the application example, a principal plane of the print element board has a parallelogram shape, but the invention is not limited thereto. For example, even when the print element boards having a rectangular shape, a trapezoid shape, and the other shapes are used, the configuration of the invention can be desirably used.

(Description of Configuration of Pressure Control Unit)

Figure 15A:
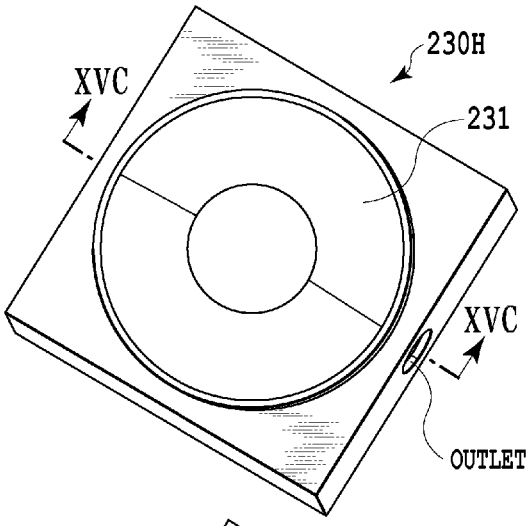
FIG. 15A is a diagram illustrating a pressure adjustment mechanism having the first circulation configuration.
Figure 15B:
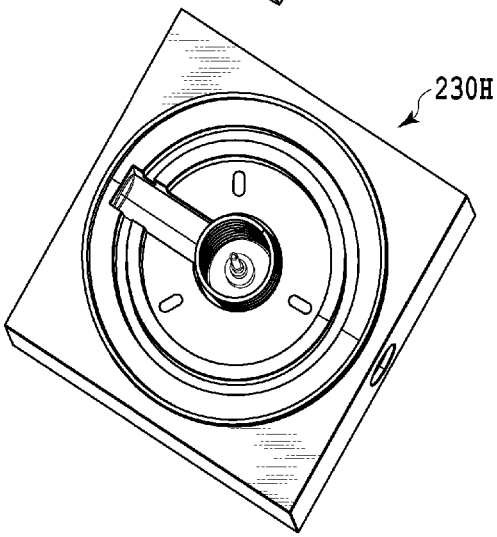
FIG. 15B is a diagram illustrating the pressure adjustment mechanism having the first circulation configuration.
Figure 15C:
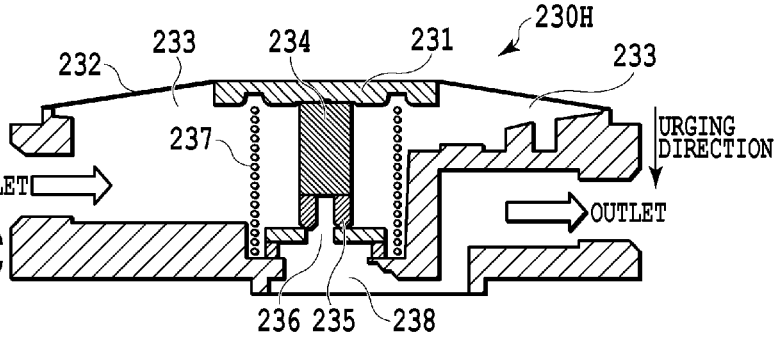
FIG. 15C is a diagram illustrating the pressure adjustment mechanism having the first circulation configuration.

FIG. 15A and FIG. 15B are external perspective views illustrating the pressure control unit 230 (back pressure valve) used in the first circulation configuration. FIG. 15C is a cross-sectional view thereof. The pressure adjustment mechanism 230L on the low pressure side has the same configuration except that a control pressure (initial load of a spring) is different, and thus a description of the pressure adjustment mechanism 230L will be omitted. An operation principle of the pressure adjustment mechanism 230H in FIG. 15A to FIG. 15C is the same as that of a mechanism generally referred to as a "back pressure valve". FIG. 15B illustrates a state in which the pressure plate 231 and the flexible film 232 are not illustrated such that the inside of the pressure adjustment mechanism 230H is easily viewed. FIG. 15C is a diagram illustrating a cross section taken along XVC-XVC line of FIG. 15A.

As illustrated in FIG. 15B and FIG. 15C, the pressure adjustment mechanism 230H includes a pressure plate 231, a first pressure chamber 233 provided at an upstream side to which the liquid ejection head 3 is connected, and the flexible film 232 that fluidly seals the pressure plate 231 and the first pressure chamber 233. In the present embodiment, the pressure plate 231 is shifted depending on the increase or decrease in ink inside the first pressure chamber, and joined to the flexible film 232 corresponding to a flexible member. In addition, the first pressure chamber 233 has a valve 235 connected by the pressure plate 231 and a shift 234, and an orifice 236 fit to the valve 235. The orifice 236 of the present embodiment is provided at a boundary between the first pressure chamber 233 and the second pressure chamber 238. The shift 234, the valve 235, and the pressure plate 231 need to be integrally moved, and are joined together using an adhesive, a fitting hole, etc. In addition, the pressure plate 231 and the valve 235 are urged by an urging member 237 (spring) in a direction in which the valve 235 is blocked.

In FIG. 15C, the valve 235 is provided at an upstream side of the orifice 236, and a gap between the orifice 236 and the valve 235 is opened when the pressure plate 231 moves upward. Ink entering from an inlet of the pressure adjustment mechanism 230H flows into the first pressure chamber 233, and delivers a pressure thereof to the pressure plate 231. Thereafter, the ink is discharged to the liquid ejection head 3 from an outlet of the pressure adjustment mechanism 230H by passing through the gap between the orifice 236 and the valve 235.

A pressure inside each pressure chamber is determined based on a relational expression below that indicates a balance of a force applied to each portion. P1 may be set to a desired control pressure by changing a force of a spring corresponding to the urging member 237. A spring constant K is changed or a spring length at the time of operation is changed in order to change the force of the spring. In order to change the spring length at the time of operation, for example, a depth of a hollow portion at which the urging member 237 comes into contact with the case side may be changed in FIG. 15C.

$$P1=P0-(P2Sv+Kx)/Sd \qquad \text{Expression (1)}$$

Herein, Sd: area of pressure plate, Sv: pressure receiving area of valve portion P0: atmospheric pressure, P1: pressure inside pressure chamber, P2: pressure at downstream side of orifice K: spring constant, x: spring displacement In Expression (1), the second term of the right side has a positive value at all times. Thus, an inequality of $P1<P0$ is satisfied, and P1 inevitably becomes a negative pressure.

In addition, when a flow resistance of the valve portion is set to R, and a rate of a flow passing through the inside of the pressure adjustment mechanism 230H is set to Q, an equation below is satisfied.

$$P2=P1-QR \qquad \text{Expression (2)}$$

Figure 14:
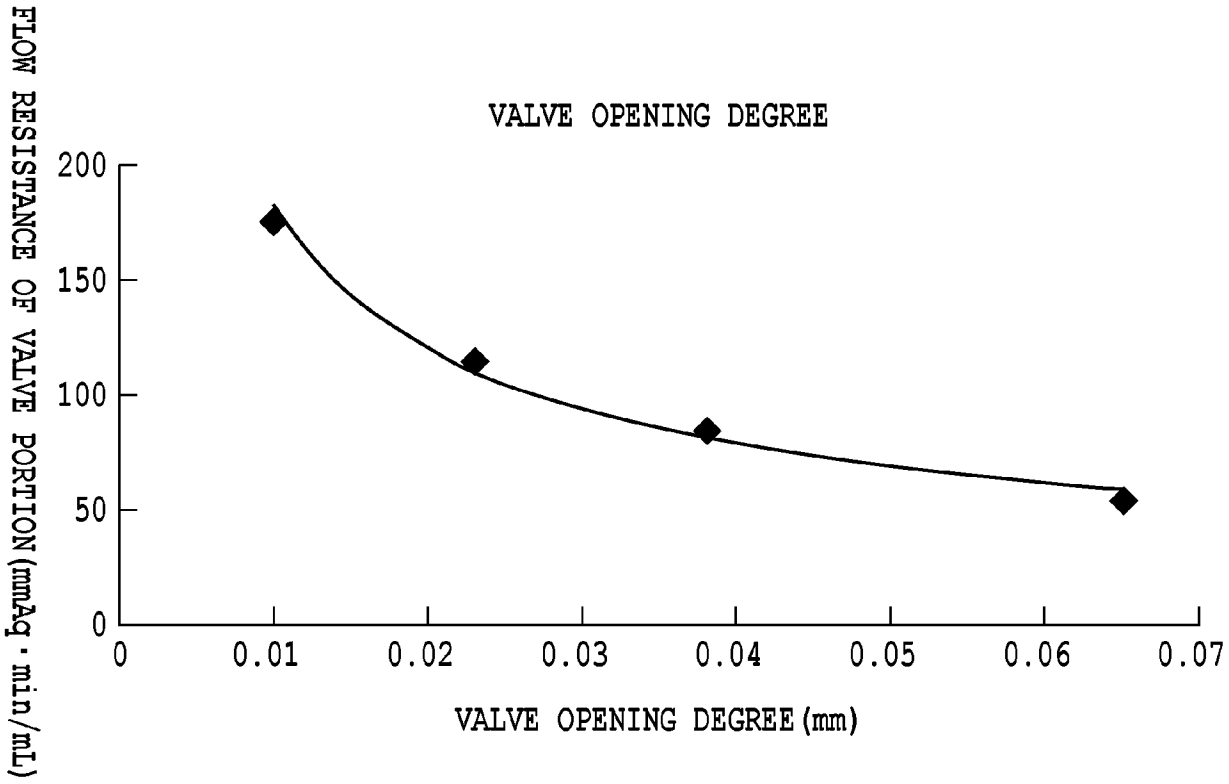
FIG. 14 is a diagram illustrating a relation between a flow resistance R and a valve opening degree.

Herein, for example, the flow resistance R of the valve portion and the valve opening degree are designed to have a relation of FIG. 14. In more detail, the flow resistance R decreases as the valve opening degree increases.

P1 is determined when a valve position is determined such that Expression (1) and Expression (2) are simultaneously satisfied. When a flow amount to the pressure adjustment mechanism 230H increases, a pressure inside the buffer tank 1003 connected to a downstream side of the pressure adjustment mechanism 230H is constant. Thus, P2 increases by an increase of a flow resistance between the pressure control unit 230 and the buffer tank 1003 due to an increase in flow amount. For this reason, a force P2Sv for opening the valve increases, and P1 instantaneously decreases by Expression (1).

In addition, $R=(P1-P2)/Q$ is derived from Expression (2). Herein, since P2 increases, and P1 decreases, R decreases. When R decreases, the valve opening degree increases. As understood from FIG. 15C, when the valve opening degree increases, the length of the urging member 237 increases.

Thus, x corresponding to displacement from a free length decreases. Thus, a force kx of the spring decreases. For this reason, P1 instantaneously increases from Expression (1). When P1 instantaneously increases, P1 instantaneously decreases by a reverse action to an action in the above description. When this phenomenon is instantaneously repeated, both Expression (1) and Expression (2) are satisfied while the valve opening degree changes depending on the flow amount Q. As a result, P1 is controlled at a constant value.

(Description of Ink Filling Time)

Figure 16:
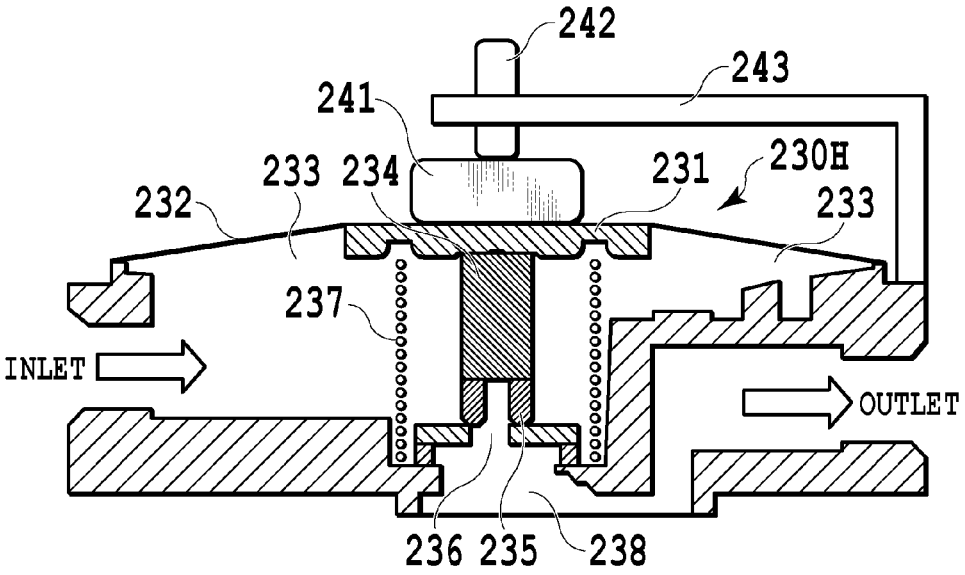
FIG. 16 is a cross-sectional view of the pressure adjustment mechanism at the time of ink filling.

Next, a description will be given of an operation of filling the liquid ejection apparatus 1000 of the present embodiment with ink. FIG. 16 is a cross-sectional view illustrating a configuration of the pressure adjustment mechanism 230H at the time of ink filling in the present embodiment. In the present example, the pressure adjustment mechanism 230H used in the second circulation configuration is described as an example. However, the same configuration may be obtained when the pressure adjustment mechanism 230H used in the first circulation configuration is adopted. The pressure adjustment mechanism 230L on the low pressure side has the same configuration except that a control pressure (initial load of a spring) is different, and thus a description of the pressure adjustment mechanism 230L will be omitted.

In the present embodiment, when the insides of the common supply passage 211, the common collection passage 212, and the individual passage 215 of the liquid ejection head 3 are filled with ink, first, a certain amount of ink is transferred from the main tank 1006 to the buffer tank 1003 by driving the replenishing pump 1005.

Subsequently, as illustrated in FIG. 16, a screw 242 is adjusted to fix a position of a constraining plate 241 such that one end of the constraining plate 241 comes into contact with the pressure plate 231 and the valve 235 is closed. The other end of the constraining plate 241 is connected to a holding member 243 through the screw 242. The holding member 243 is fixed to a main body of the pressure adjustment mechanism 230H, and fixes the constraining plate 241. The constraining plate 241, the screw 242, and the holding member 243 have rigidity that reduces deformation of the pressure plate 231 with respect to a pressure received by the pressure plate 231 resulting from pressurization from the first circulation pumps 1001 and 1002 and the second circulation pump 1004. In the present embodiment, the screw 242 is used to fix the position of the constraining plate 241. However, a manual lever mechanism, a motor, etc. may be used.

Subsequently, the insides of the common supply passage 211, the common collection passage 212, and the individual passage 215 of the liquid ejection head 3 are filled with ink by driving the first circulation pumps 1001 and 1002 and the second circulation pump 1004 to press ink inside the circulation path. When the circulation pumps 1001 to 1004 are driven, the constraining plate 241 causes the pressure plate 231 of the pressure adjustment mechanism 230H to close the valve 235. Thus, the valve 235 is not opened even when a pressure inside the pressure adjustment mechanism rises. For this reason, the passage inside the liquid ejection head 3 may be maintained in a pressurized state and filled with ink. After the passage inside the liquid ejection head 3 is filled with ink, the screw 242 is opened to separate the constraining plate 241 from the pressure plate 231. Then, the valve 235 is opened, and the circulation passage to the pressure control unit 230 (the pressure adjustment mechanism 230H and the pressure adjustment mechanism 230L) and the buffer tank 1003 is filled with ink.

When a forcible blocking mechanism such as the constraining plate 241, the screw 242, the holding member 243, etc. is used for the pressure adjustment mechanism 230H, the inside of the liquid ejection apparatus 1000 may be filled with ink without separately providing a valve in the ink circulation path. According to this configuration, a mechanism for applying a pressure to the inside of the liquid ejection head is not needed when the liquid ejection apparatus 1000 is replenished with ink, and thus it is possible to suppress an increase in cost and to inhibit an apparatus structure from being complicated.

Embodiment 2

Hereinafter, configurations of an liquid ejection apparatus 2000 and a liquid ejection head 2003 according to an embodiment 2 will be described with reference to the drawings. In the description below, only a difference from the embodiment 1 will be described and a description of the same components as those of the embodiment 1 will be omitted.

(Description of Liquid Ejection Apparatus)

Figure 17:
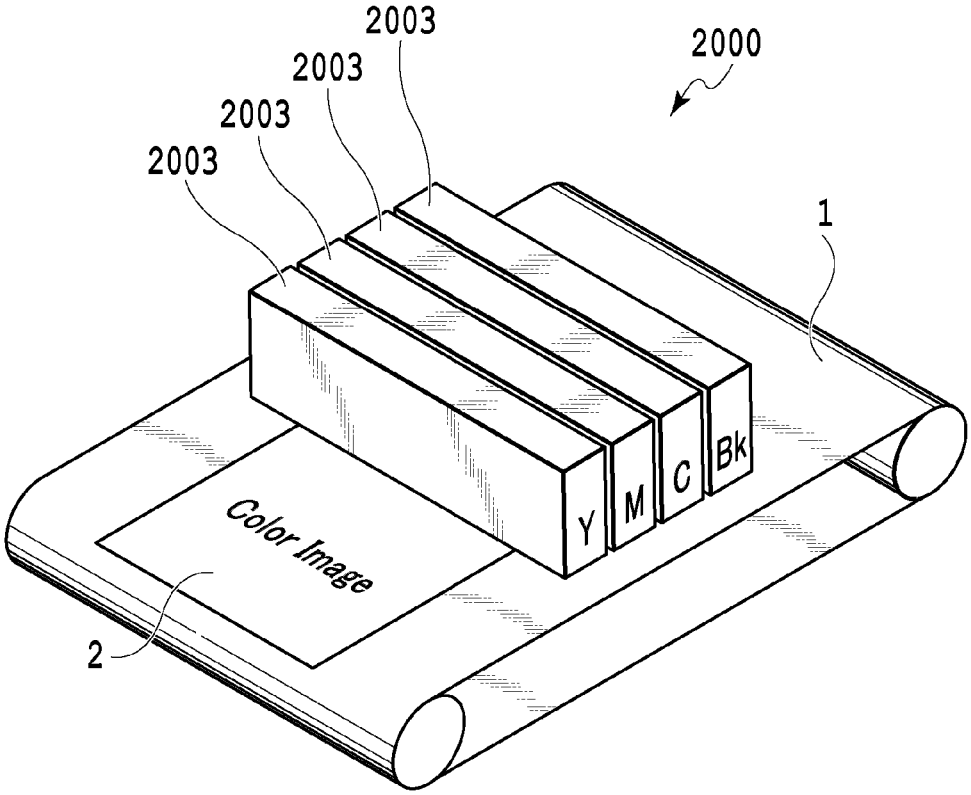
FIG. 17 is a schematic configuration diagram of a liquid ejection apparatus in Embodiment 2.

FIG. 17 is a diagram illustrating the liquid ejection apparatus 2000 according to the present embodiment. The liquid ejection apparatus 2000 of the present embodiment is different from the embodiment 1 in that a full color image is printed on the print medium by a configuration in which four monochromic liquid ejection heads 2003 respectively corresponding to the inks of cyan C, magenta M, yellow Y, and black K are disposed in parallel. In the embodiment 1, the number of the ejection opening rows which can be used for one color is one. However, in the present embodiment, the number of the ejection opening rows which can be used for one color is twenty. For this reason, when print data is appropriately distributed to a plurality of ejection opening rows to print an image, an image can be printed at a higher speed. Further, even when there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to embodiment 1, the supply system, the buffer tank 1003 (see FIGS. 2 and 3), and the main tank 1006 (see FIGS. 2 and 3) of the liquid ejection apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the embodiment 1, the first and second circulation configurations illustrated in FIG. 2 or 3 can be used as the liquid circulation configuration between the liquid ejection apparatus 2000 and the liquid ejection head 2003.

(Description of Structure of Liquid Ejection Head)

Figure 18A:
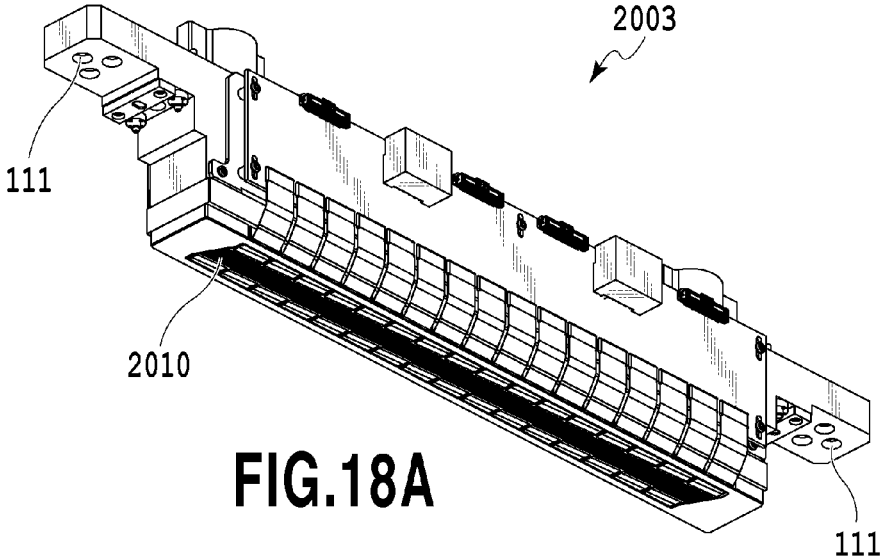
FIG. 18A is a perspective view illustrating a liquid ejection head in Embodiment 2.
Figure 18B:
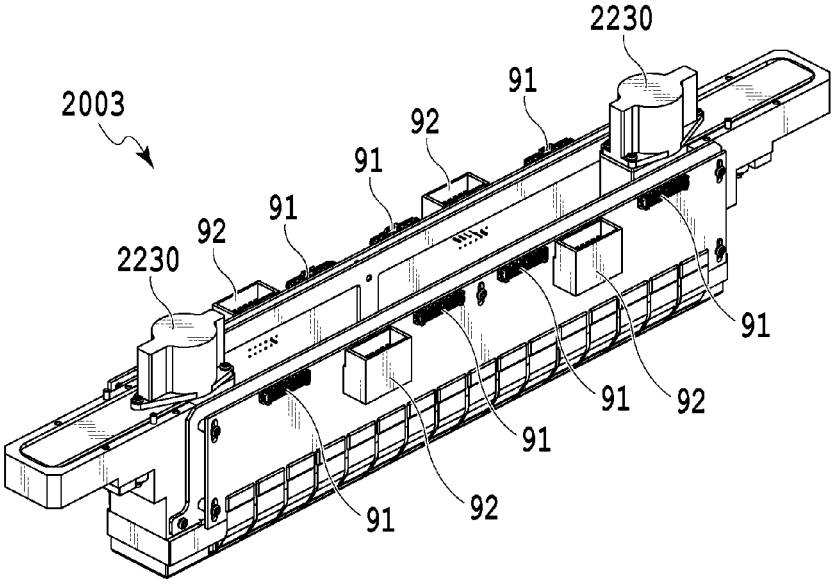
FIG. 18B is a perspective view illustrating the liquid ejection head in Embodiment 2.

FIGS. 18A and 18B are perspective views illustrating the liquid ejection head 2003 according to the present embodiment. Here, a structure of the liquid ejection head 2003 according to the present embodiment will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the embodiment 1, the liquid ejection head 2003 includes the liquid connection portion 111, the signal input terminal 91, and the power supply terminal 92. However, since the liquid ejection head 2003 of the present embodiment includes many ejection opening rows compared with the embodiment 1, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 23A:
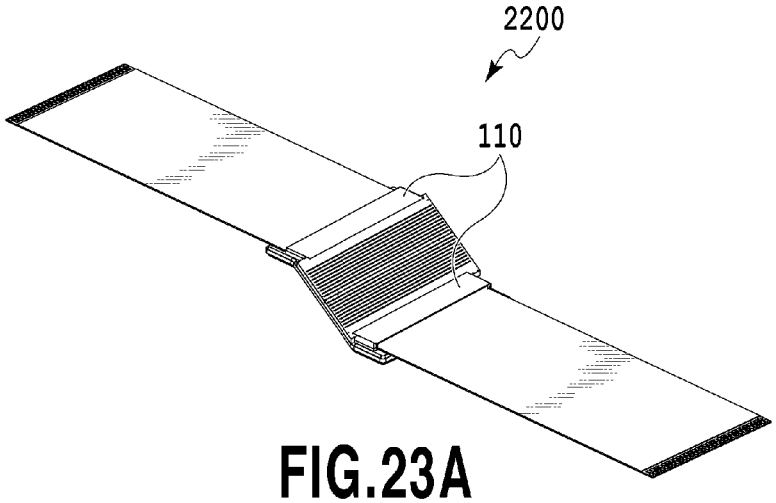
FIG. 23A is a diagram illustrating an ejection module in Embodiment 2.
Figure 23B:
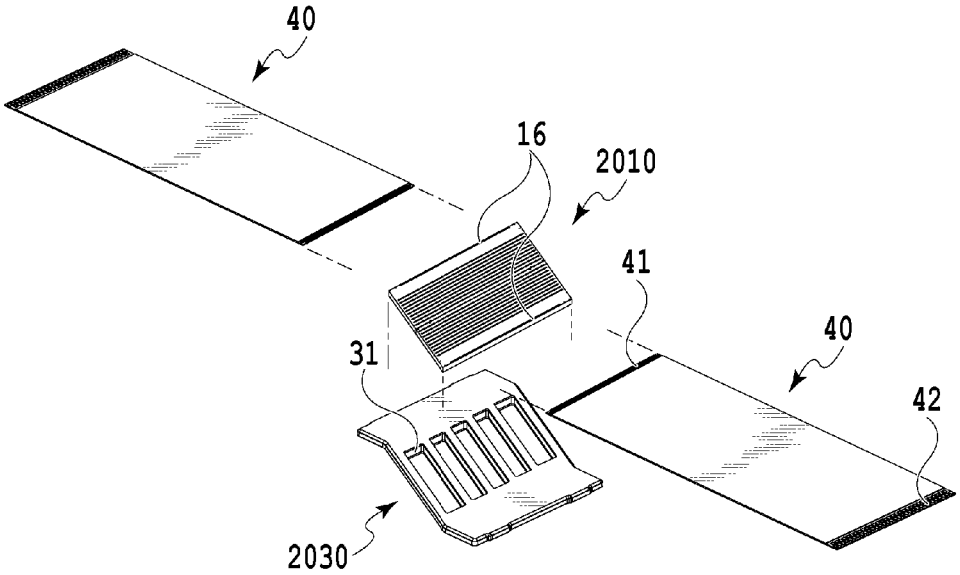
FIG. 23B is a diagram illustrating the ejection module in Embodiment 2.

FIGS. 23A and 23B are oblique exploded views illustrating the liquid ejection head 2003 and components or units constituting the liquid ejection head 2003 according to the functions thereof. The function of each of units and members or the liquid flow sequence inside the liquid ejection head is basically similar to that of the embodiment 1, but the function of guaranteeing the rigidity of the liquid ejection head is different. In the embodiment 1, the rigidity of the liquid ejection head is mainly guaranteed by the liquid ejection unit support portion 81, but in the liquid ejection head 2003 of the embodiment 2, the rigidity of the liquid ejection head is guaranteed by a second passage member 2060 included in a liquid ejection unit 2300. The liquid ejection unit support portion 81 of the present embodiment is connected to both ends of the second passage member 2060 and the liquid ejection unit 2300 is mechanically connected to a carriage of the liquid ejection apparatus 2000 to position the liquid ejection head 2003. The electric wiring board 90 and a liquid supply unit 2220 including a pressure control unit 2230 are connected to the liquid ejection unit support portion 81. Each of two liquid supply units 2220 includes a filter (not illustrated) built therein.

Two pressure control units 2230 are set to control a pressure at different and relatively high and low negative pressures. Further, as in FIGS. 18A and 18B, when the pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Figure 19:
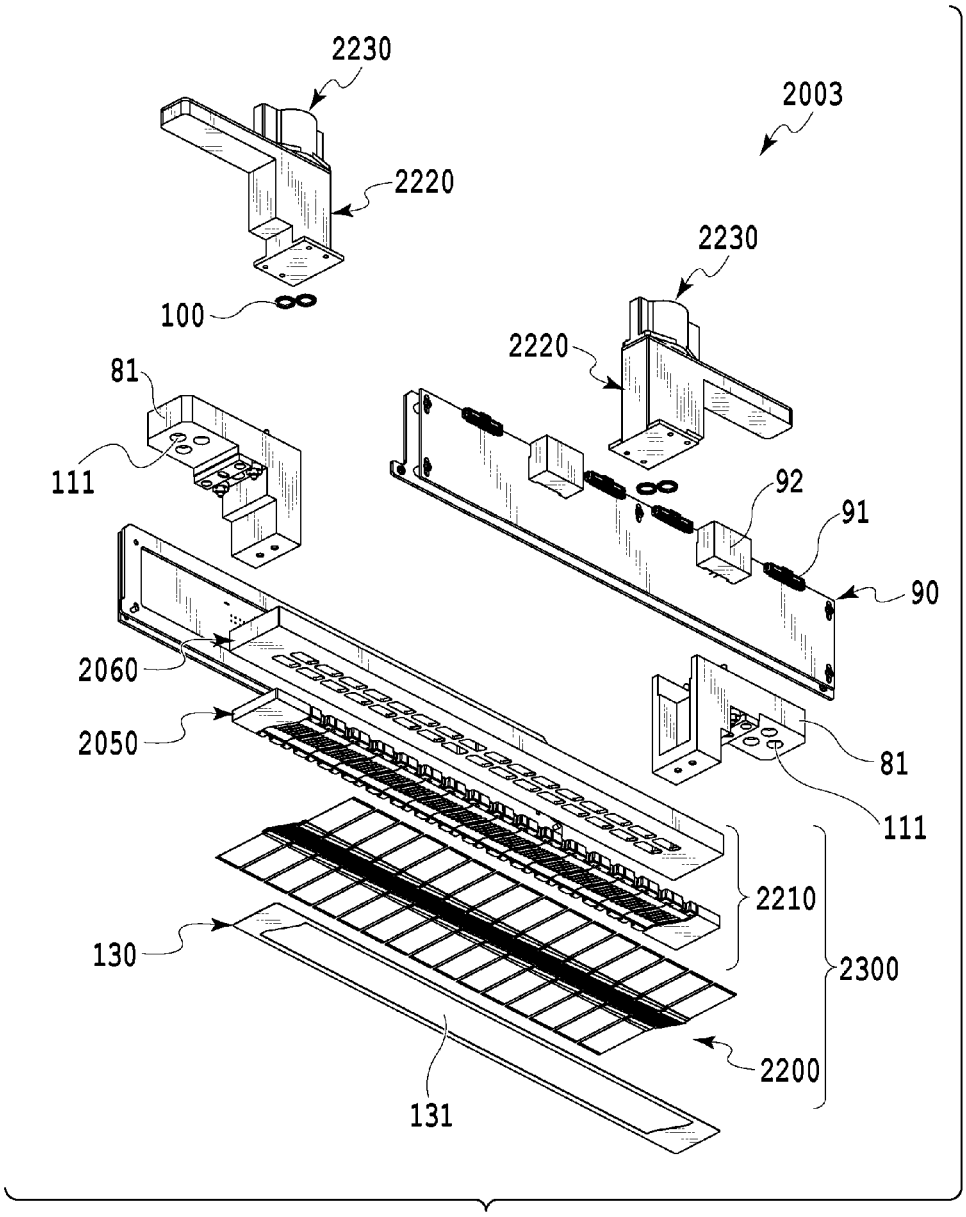
FIG. 19 is an oblique exploded view of the liquid ejection head in Embodiment 2.

Next, a detailed configuration of a passage member 2210 of the liquid ejection unit 2300 will be described. As illustrated in FIG. 19, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 20:
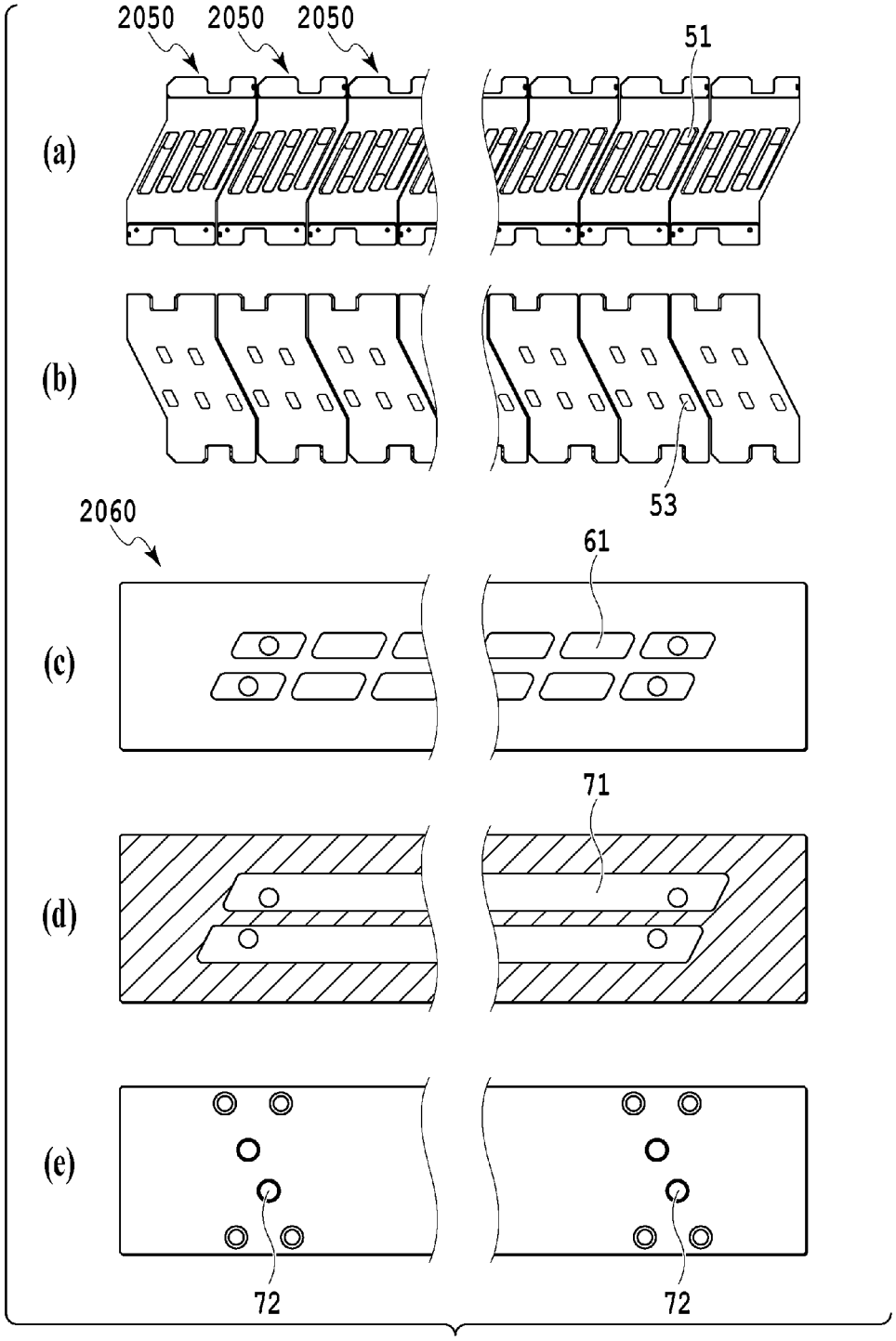
FIG. 20 is a diagram illustrating the first passage member in Embodiment 2.

A reference character (a) in FIG. 20 is a diagram illustrating a face onto which the ejection module 2200 is mounted in the first passage member 2050 and a reference character (b) is a diagram illustrating a rear face thereof and a face contacting the second passage member 2060. Differently from the embodiment 1, the first passage member 2050 of the present embodiment has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in the reference character (a), the communication opening 51 of the first passage member 2050 fluid-communicates with the ejection module 2200. As illustrated in the reference character (b), the individual communication opening 53 of the first passage member 2050 fluid-communicates with the communication opening 61 of the second passage member 2060. A reference character (c) illustrates a contact face of the second passage member 60 with respect to the first passage member 2050, a reference character (d) illustrates a cross-section of a center portion of the second passage member 60 in the thickness direction, and a reference character (e) is a diagram illustrating a contact face of the second passage member 2060 with respect to the liquid supply unit 2220. The function of the communication opening or the passage of the second passage member 2060 is similar to each color of the embodiment 1. The common passage groove 71 of the second passage member 2060 is formed such that one side thereof is a common supply passage 2211 illustrated in FIG. 21 and the other side thereof is a common collection passage 2212. These passages are respectively provided along the longitudinal direction of the liquid ejection head 2003 so that the liquid is supplied from one end thereof to the other end thereof. The present embodiment is different from the embodiment 1 in that the liquid flow directions in the common supply passage 2211 and the common collection passage 2212 are opposite to each other.

Figure 21:
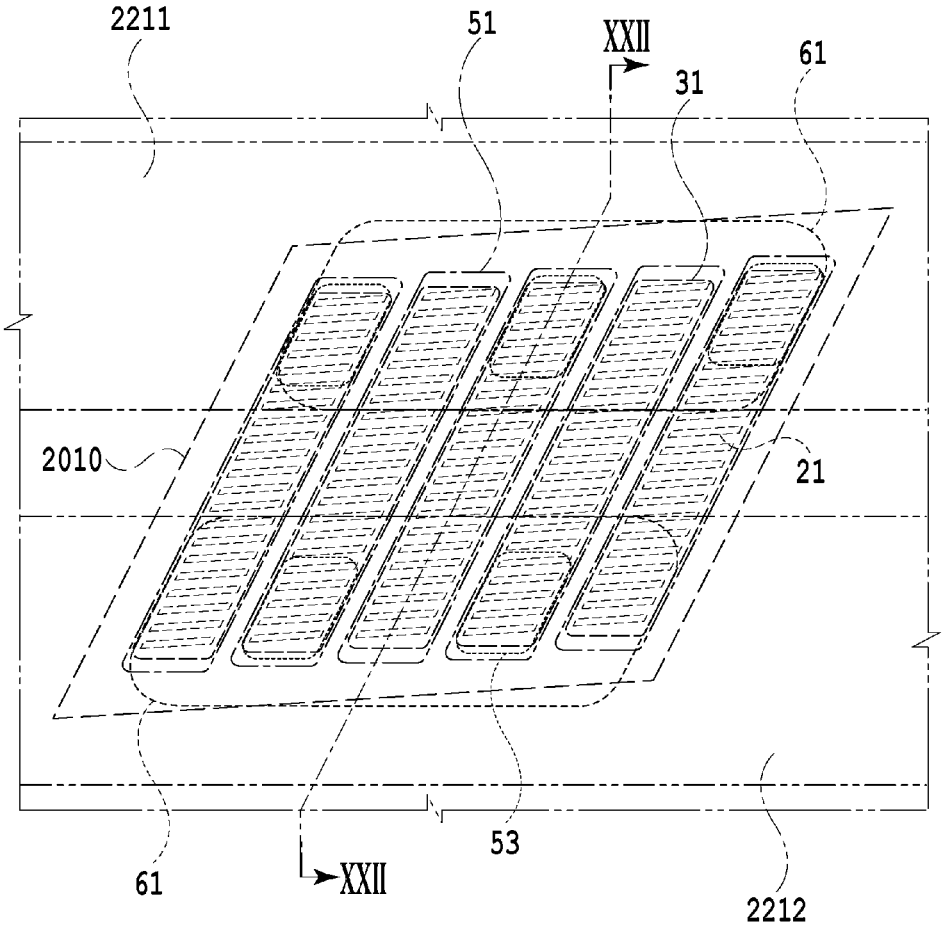
FIG. 21 is an enlarged perspective view around a print element board in Embodiment 2.

FIG. 21 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening 61 from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 22:
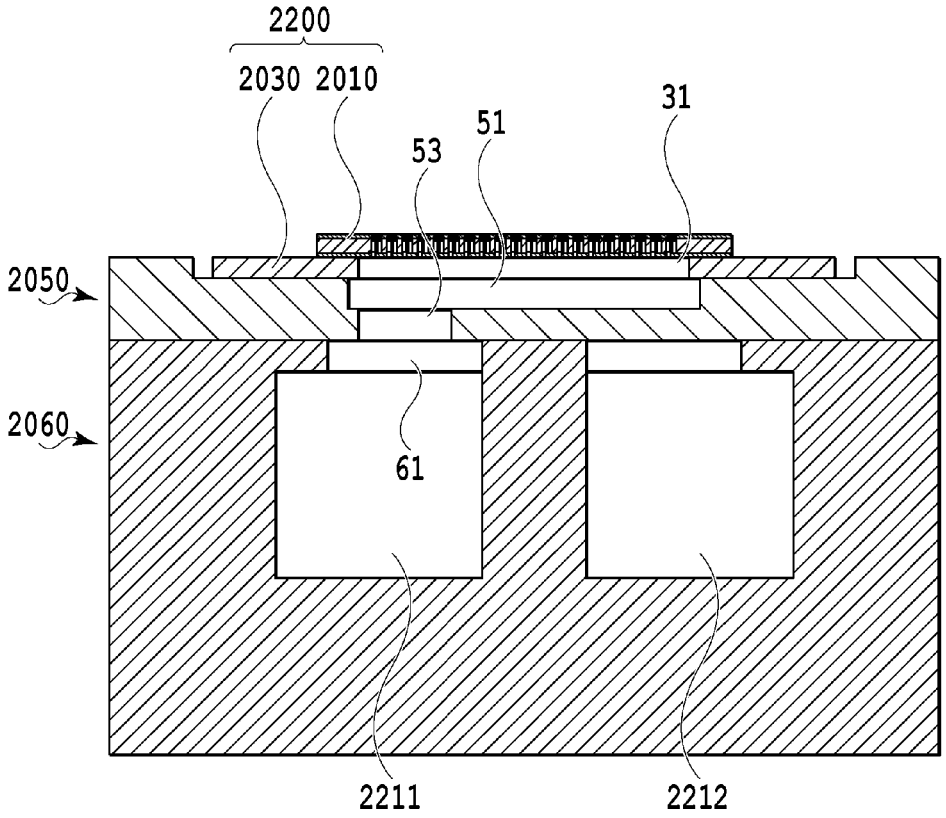
FIG. 22 is a diagram illustrating a cross section taken along XXII-XXII line of FIG. 21.

FIG. 22 is a cross-sectional view taken along a line XXII-XXII of FIG. 21. The common supply passage 2211 is connected to the ejection module 2200 through the communication opening 61, the individual communication opening 53, and the communication opening 51. Although not illustrated in FIG. 22, it is obvious that the common collection passage 2212 is connected to the ejection module 2200 by the same path in a different cross-section in FIG. 21. Similarly to the embodiment 1, each of the ejection module 2200 and the print element board 2010 is provided with a passage communicating with each ejection opening and thus a part or the entirety of the supplied liquid can be recirculated while passing through the ejection opening that does not perform the ejection operation. Further, similarly to the embodiment 1, the common supply passage 2211 is connected to the pressure control unit 2230 (the high pressure side) and the common collection passage 2212 is connected to the pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

FIG. 23A is a perspective view illustrating one ejection module 2200 and FIG. 23B is an exploded view thereof. A difference from the embodiment 1 is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the embodiment 1. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the embodiment 1.

Figure 24:
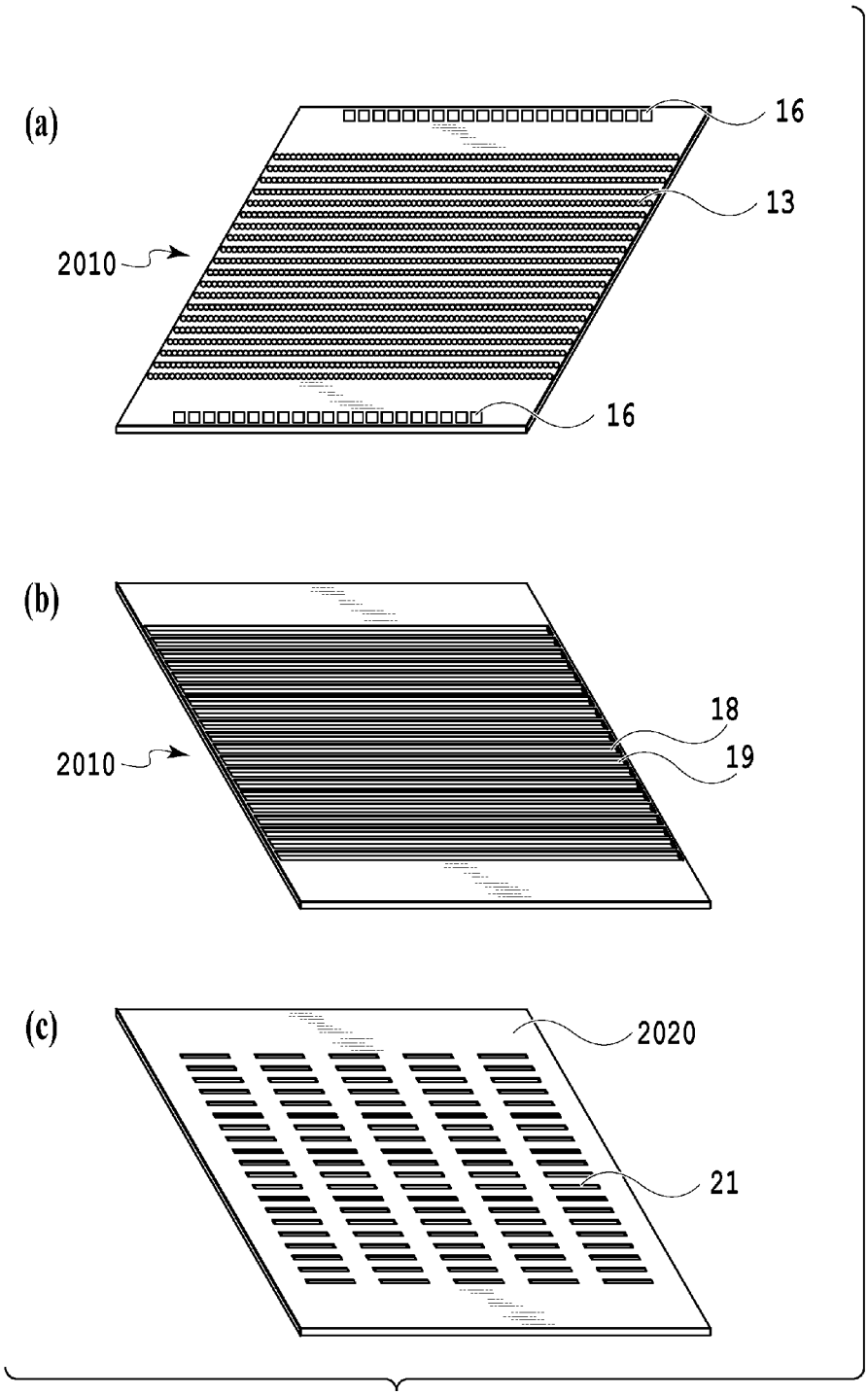
FIG. 24 is a diagram illustrating the print element board in Embodiment 2.

A reference character (a) in FIG. 24 is a schematic diagram illustrating a face on which the ejection opening 13 is disposed in the print element board 2010 and a reference character (c) is a schematic diagram illustrating a rear face of the face of the reference character (a). A reference character (b) is a schematic diagram illustrating a face of the print element board 2010 when a lid member 2020 provided in the rear face of the print element board 2010 in the reference character (c) is removed. As illustrated in the reference character (b), the liquid supply path 18 and the liquid collection path 19 are alternately provided along the ejection opening row direction at the rear face of the print element board 2010. The number of the ejection opening rows is larger than that of the embodiment 1. However, a basic difference from the embodiment 1 is that the terminal 16 is disposed at both sides of the print element board in the ejection opening row direction as described above. A basic configuration is similar to the embodiment 1 in that a pair of the liquid supply path 18 and the liquid collection path 19 is provided in each ejection opening row and the lid member 2020 is provided with the opening 21 communicating with the liquid communication opening 31 of the support member 2030.

In addition, the description of the above-described embodiment does not limit the scope of the invention. As an example, in the present embodiment, a thermal type has been described in which bubbles are generated by a heating element to eject the liquid. However, the invention can be also applied to the liquid ejection head which employs a piezo type and the other various liquid ejection types.

In the present embodiment, the liquid ejection apparatus (the printing apparatus) has been described in which the liquid such as ink is circulated between the tank and the liquid ejection head, but the other embodiments may be also used. In the other embodiments, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the present embodiment, an example of using a so-called page wide type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the invention is not limited thereto. That is, a liquid ejection head which is shorter than the width of the print medium and includes a plurality of print element boards disposed so that the ejection openings overlap each other in the ejection opening row direction may be provided and the print medium may be scanned by the liquid ejection head.

Embodiment 3

Hereinafter, a description will be given of a configuration of a liquid ejection head 3300, etc. according to Embodiment 3 of the invention with reference to drawings. In description below, only a different part from that in Embodiments 1 and 2 will be mainly described, and description of a similar part to that in Embodiments 1 and 2 will be omitted.

(Description of Circulation Configuration)

Figure 25:
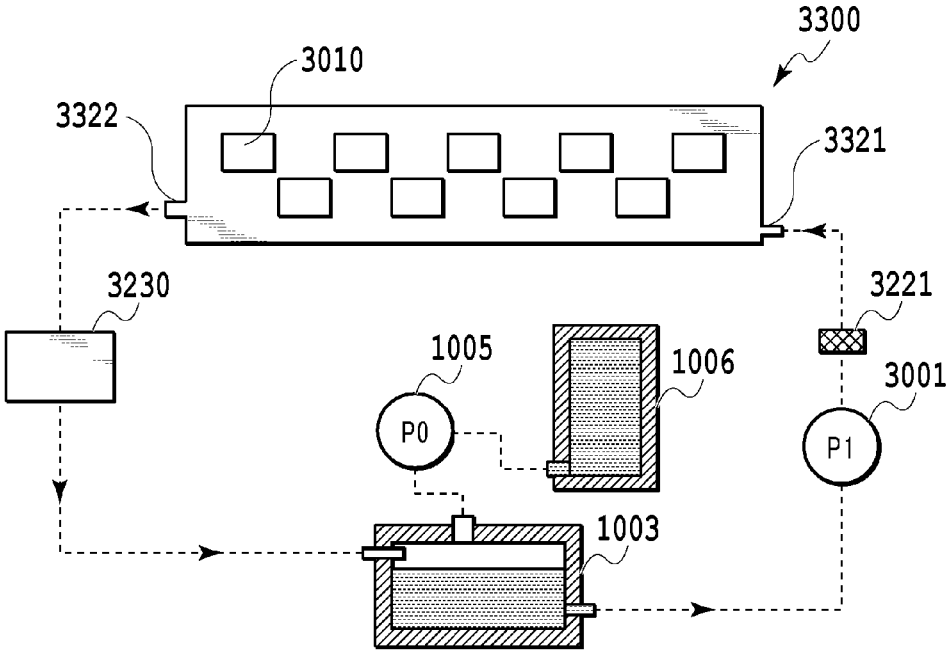
FIG. 25 is a schematic diagram illustrating a circulation configuration in Embodiment 3.

FIG. 25 is a schematic diagram illustrating a circulation configuration applied to a liquid ejection apparatus of the present embodiment. Main differences from the above-described first circulation configuration are that a configuration inside the liquid ejection head 3300 is different, and ink supplied from a buffer tank 1003 arrives at the liquid ejection head 3300 through a single passage. Another difference from the first circulation configuration resulting therefrom is that each of a filter 3221 positioned at an upstream side of the liquid ejection head 3300 and a pressure adjustment mechanism 3230 positioned at a downstream side of the liquid ejection head 330 has a single configuration. Even though the liquid supply unit 220, the second circulation pump 1004, etc. are removed when compared to Embodiments 1 and 2, the liquid supply unit 220, the second circulation pump 1004, etc. may be included in the present circulation configuration.

Similarly to the first circulation configuration, the pressure adjustment mechanism 3230 stabilizes a pressure variation at an upstream side (that is, the liquid ejection head 3300 side) within a certain range around a preset pressure even when a flow amount changes due to a change in ejection amount per unit area. The pressure adjustment mechanism 3230 of the present embodiment operates similarly to the pressure adjustment mechanism 230 described using FIG. 15A to FIG. 15C.

(Description of Configuration of Liquid Ejection Head)

Figure 26A:
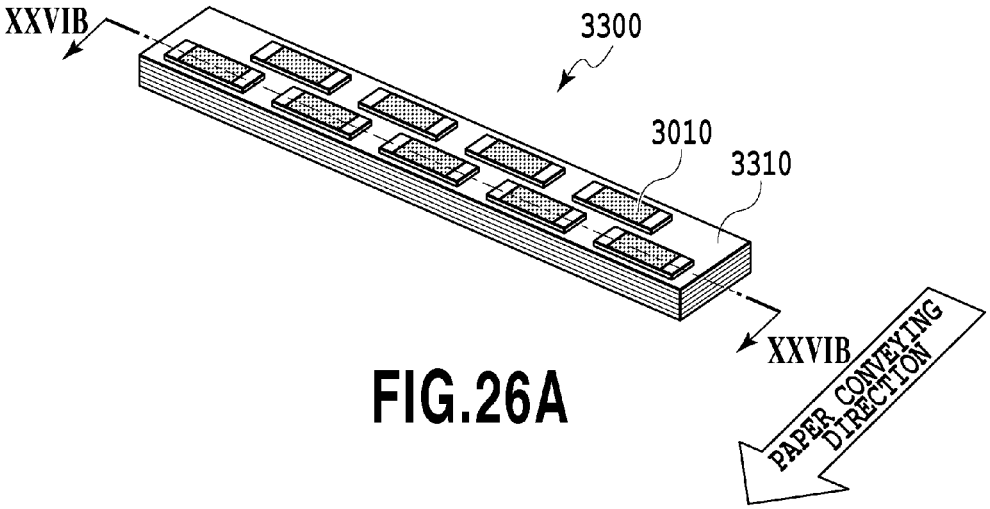
FIG. 26A is a diagram illustrating a configuration of a liquid ejection head in Embodiment 3.
Figure 26B:
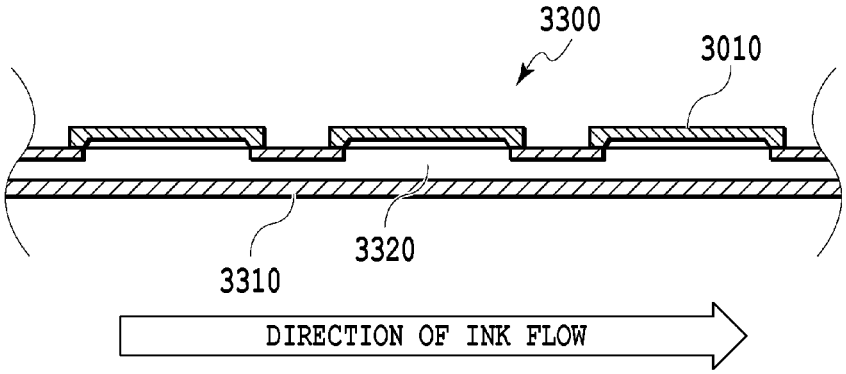
FIG. 26B is a diagram illustrating the configuration of the liquid ejection head in Embodiment 3.

FIG. 26A and FIG. 26B are diagrams illustrating a configuration of the liquid ejection head 3300 of the present embodiment. FIG. 26A is a perspective view of the liquid ejection head 3300 of the present embodiment, and FIG. 26B is a cross-sectional view taken along XXVIB-XXVIB line illustrated in FIG. 26A. In FIG. 26A and FIG. 26B, a flexible printed circuit and a sealing material are not illustrated to facilitate understanding of the configuration.

The liquid ejection head 3300 of the present embodiment includes a plurality of print element boards 3010 and a base substrate 3310 that supports the print element boards 3010. As illustrated in FIG. 26B, a common passage 3320 for supplying ink to each print element board is provided inside the base substrate.

Figure 27:
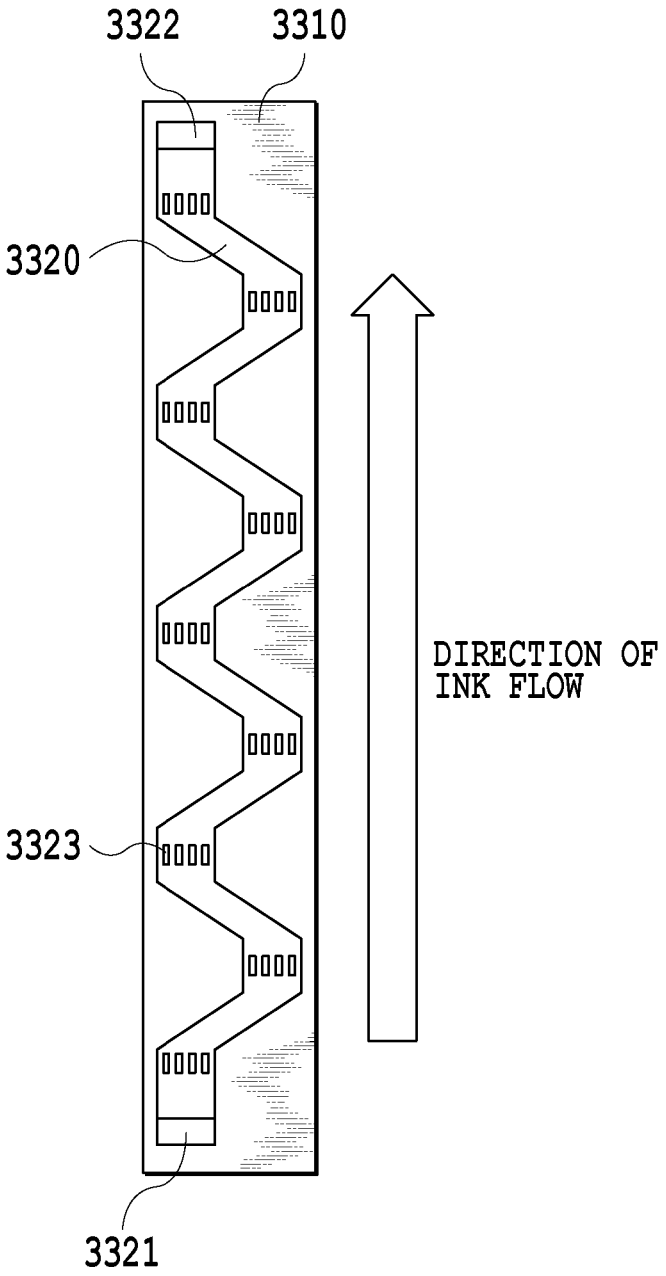
FIG. 27 is a diagram illustrating an internal configuration of the liquid ejection head in Embodiment 3.

FIG. 27 is a schematic diagram illustrating an internal configuration of the liquid ejection head 3300. As illustrated in FIG. 27, the common passage 3320 extending along a longitudinal direction of the base substrate 3310 is formed in zigzag inside the liquid ejection head 3300. An ink inlet 3321 fluidly connected to the buffer tank 1003, etc. outside the liquid ejection head 3300, an ink outlet 3322, and an ink supply opening 3323 for supplying ink to the print element boards 3010 are formed in the common passage 3320. The base substrate 3310 may form the common passage 3320 by stacking and forming a plurality of plate-shaped members. The base substrate 3310 preferably has rigidity at which the liquid ejection head 3300 does not warp. In addition, the base substrate 3310 needs to have sufficient corrosion resistance with respect to ink, and is preferably made of a material having a low linear expansion coefficient. For example, as the material of the base substrate 3310, a composite material obtained by adding inorganic filler such as fine silica particles to a base material such as alumina, a resin material, liquid crystal polymer (LCP), polyphenyl sulfide (PPS), or polysulfone (PSF) can be appropriately used. Although not illustrated, the FPC is disposed on the base substrate 3310, and electrically connected to an electrode on the print element board 3010.

The base substrate 3310 extends in a direction intersecting a paper conveying direction (a direction of an arrow illustrated in FIG. 26B), and the plurality of print element boards 3010 is arranged in zigzag along the longitudinal direction of the base substrate 3310 is while positions thereof are shifted from each other in a short direction of the base substrate 3310. As described above, the liquid ejection head 3300 of the present embodiment is a page wide type liquid ejection head. Arrangement of the plurality of print element boards 3010 is not restricted to zigzag arrangement. For example, the print element boards 3010 may be arranged in a straight line shape in the longitudinal direction of the base substrate 3310. Alternatively, the print element boards 3010 may be arranged such that each ejection opening row is inclined at a certain angle with respect to the longitudinal direction of the base substrate 3310, and central locations of the respective print element boards 3010 are parallel with the longitudinal direction of the base substrate 3310.

(Description of Configuration of Print Element Board)

Figure 28:
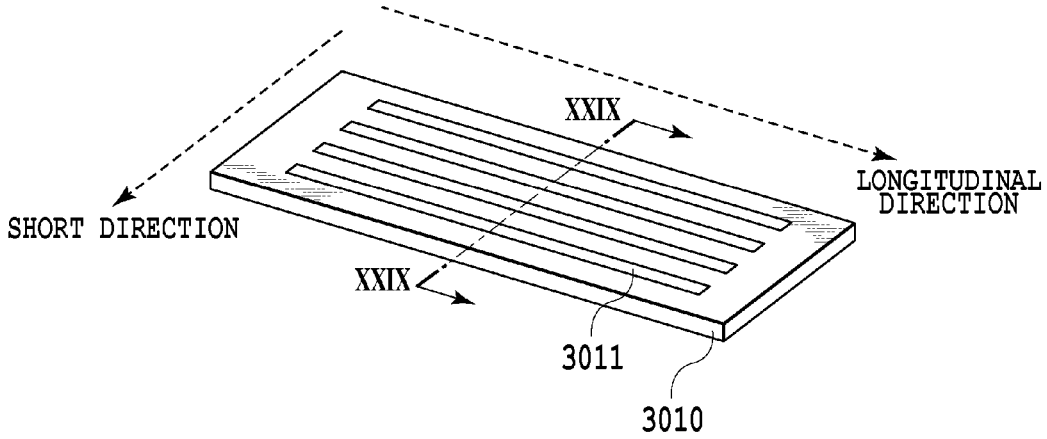
FIG. 28 is a diagram illustrating a print element board in Embodiment 3.
Figure 29:
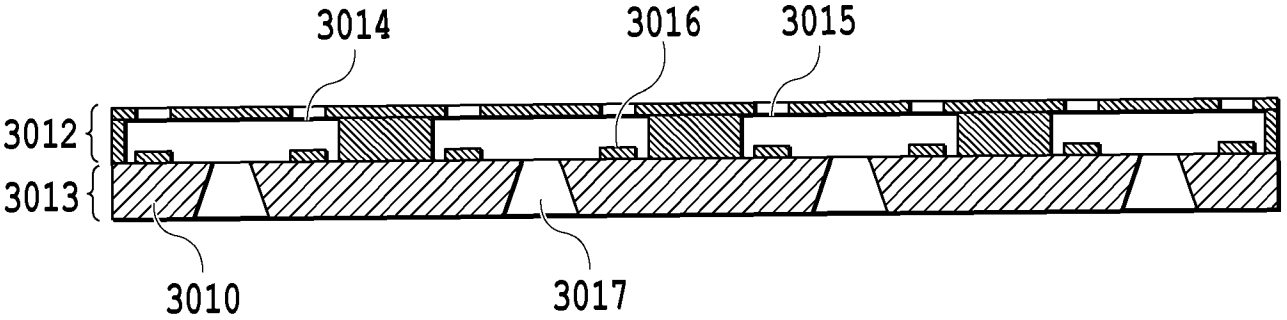
FIG. 29 is a diagram illustrating a cross section taken along XXIX-XXIX line of FIG. 28.

FIG. 28 is a schematic diagram of one of the print element boards 3010 of the present embodiment, and FIG. 29 is a cross-sectional view of the print element board 3010 taken along XXIX-XXIX line of FIG. 28.

As illustrated in FIG. 28 and FIG. 29, the print element board 3010 has four ejection opening portions 3011 formed by arranging a plurality of ejection opening rows. One of the ejection opening portions 3011 includes two ejection opening rows. That is, eight ejection opening rows are formed in each of the print element boards 3010.

In the present embodiment, the ejection opening portion 3011 extends in the longitudinal direction of the base substrate 3310. However, the embodiment is not restricted thereto. For example, the ejection opening portion 3011 may extend to incline to the longitudinal direction of the base substrate 3310.

The print element board 3010 ejects ink using a bubble jet scheme. Specifically, as illustrated in FIG. 29, the print element board 3010 includes a passing forming member 3012 and a substrate 3013. Foaming chambers 3014 for foaming ink and ejection openings 3015 for ejecting ink drops are formed in the passing forming member 3012.

Heating resistance elements 3016 corresponding to energy generation elements are disposed at positions corresponding to the foaming chambers 3014 in the substrate 3013. The heating resistance elements 3016 are disposed on a straight line along the ejection opening rows, and the ejection openings 3015 are arranged at predetermined positions in a row shape to correspond to the respective heating resistance elements 3016. In addition, the substrate 3013 has an ink supply opening 3017 communicating with the ink supply opening 3323 of the base substrate 3310 on a surface on the opposite side from the passing forming member 3012. One ink supply opening 3017 communicates with a plurality of ejection openings 3015.

An electric wire (not illustrated) is formed inside the substrate 3013. The electric wire is electrically connected to an electrode of the FPC. When a pulse voltage is input to the substrate 3013 through the electrode from an external control circuit (not illustrated), the heating resistance elements 3016 generates heat, and ink inside the foaming chambers 3014 boils. Ink foams by the boiling, and ink is ejected from the ejection openings 3015. In the present embodiment, a main plane of the print element board 3010 is rectangular. However, the invention is not restricted thereto. For example, the configuration of the invention may be suitably implemented even when the print element board has a parallelogram shape, a trapezoid shape, or other shapes.

Figure 30:
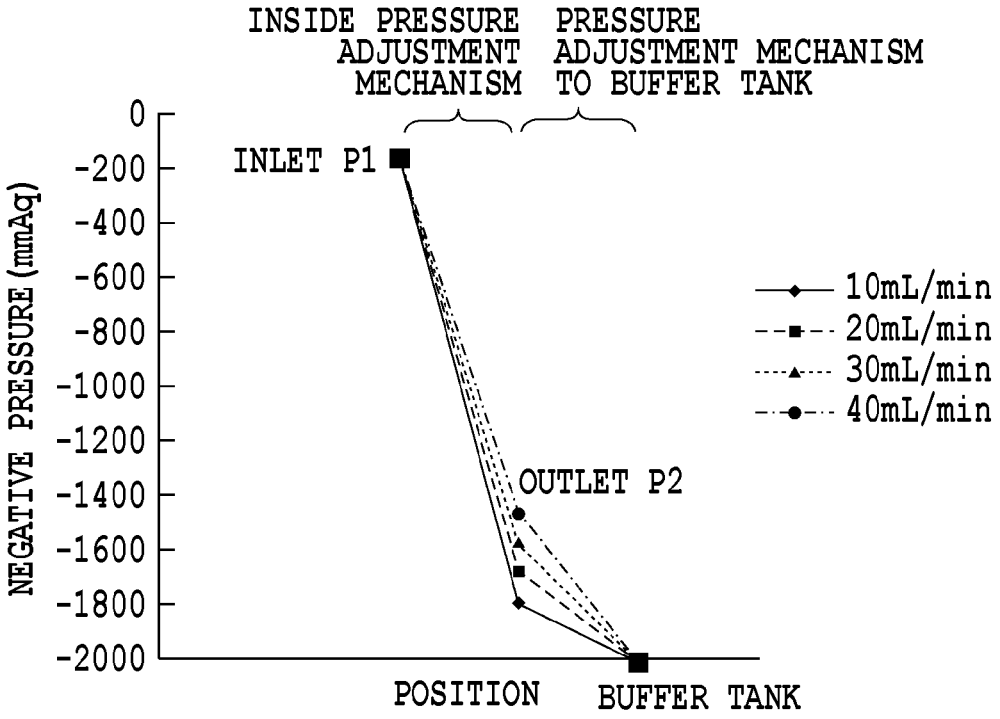
FIG. 30 is a diagram illustrating a change in pressure distribution when a printing duty is changed in a circulation path of Embodiment 3.

FIG. 30 is a diagram illustrating a change in pressure distribution inside the head when a printing duty is changed in a circulation path in the present embodiment.

The flow resistance R, the area Sd of the pressure plate, the pressure receiving area Sv of the valve, and the spring constant K are set as in Table 1, and a flow amount of a circulation pump 3001 is set to 30 mL/min. According to this setting, a flow amount of ink flowing out of the ink outlet 3322 of the liquid ejection head 3300 becomes 30 mL/min when the printing duty is 0% and 10 mL/min when the printing duty is 100%. In other words, since a certain amount of ink flow amount is sent from the upstream side of the liquid ejection head 3300, an ink flow amount obtained by subtracting the amount of ink (Max. 20 mL/min) used for printing flows into the pressure adjustment mechanism 3230 from the liquid ejection head 3300. As a result, a flow amount of the pressure adjustment mechanism 3230 is in a range of 10 to 30 mL/min.

In addition, an internal pressure inside the buffer tank 1003 is fixed and set to −2,000 mmAq, and a relation between a valve opening degree and a flow resistance R of the valve portion is set the relation illustrated in FIG. 14.

As understood from FIG. 30, when an ink flow amount changes, pressure loss between the pressure adjustment mechanism 3230 and the buffer tank 1003 varies due to an influence of a joint portion corresponding to a connecting portion of the circulation path or a tube included in the circulation path. For this reason, even though a pressure P2 at an inlet position of the pressure adjustment mechanism 3230 varies, a pressure P1 at an outlet position does not vary, and a pressure at the downstream side of the liquid ejection head 3300 is controlled at a constant value by the pressure adjustment mechanism 3230.

In this way, the pressure adjustment mechanism 3230 of the present embodiment may control a pressure at an inlet of the pressure adjustment mechanism 3230 (that is, the ink outlet 3322) at a constant value. Further, in the circulation path of the present embodiment, similarly to the above-described Embodiment 2, the filter 3221 is disposed at the upstream side of the liquid ejection head 3300, and the pressure adjustment mechanism 3230 is disposed at the downstream side of the liquid ejection head 330. According to this configuration, there is no concern that a foreign substance may enter the liquid ejection head 3300.

TABLE 1

| | | | |
|---|---|---|---|
| Flow resistance R between buffer tank and pressure adjustment unit | Joint portion | 4.2 | mmAg min/mL |
| | Tube | 2.0 | mmAg mim/mL |
| Area Sd of pressure plate | 60 | $mm^2$ | |
| Pressure receiving area Sv of valve | 1.0 | $mm^2$ | |
| Spring constant K | 0.1 | N/mm | |

Comparative Example

Figure 31:
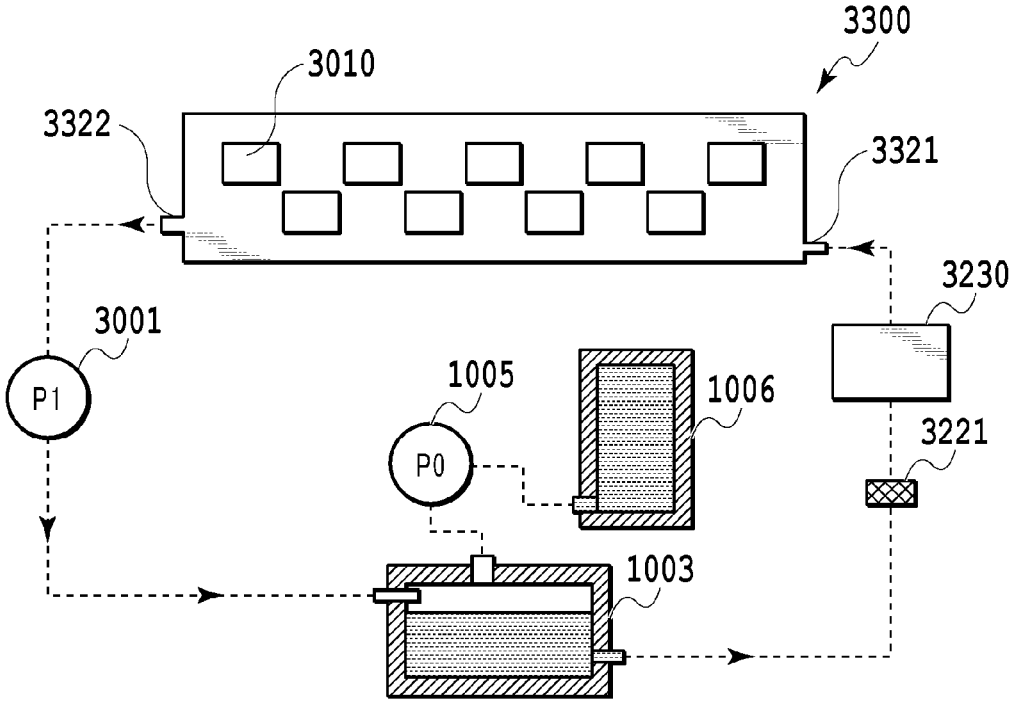
FIG. 31 is a schematic diagram illustrating a circulation configuration of a conventional art.

FIG. 31 is a schematic diagram illustrating a circulation configuration in a liquid ejection apparatus of a conventional art. In the circulation configuration of the conventional art, a circulation pump 3001 is disposed at a downstream of a liquid ejection head 3300, and a pressure adjustment mechanism 3230 is disposed at an upstream side of the liquid ejection head 3300. The pressure adjustment mechanism 3230 has the same configuration as that of a so-called secondary pressure regulator, and operates to maintain a pressure at a downstream side of the pressure adjustment mechanism 3230 at a constant value.

A flow amount of the circulation pump 3001 is set to 30 mL/min. In this instance, a flow amount of ink flowing out of an ink outlet 3322 of the liquid ejection head 3300 becomes 30 mL/min (same as setting of FIG. 30) when a printing duty is 0%. Meanwhile, a flow amount of ink flowing into an ink inlet 3321 of the liquid ejection head 3300 becomes 50 mL/min when the printing duty is 100%. In other words, since a certain amount of ink flow amount is drawn from a downstream side of the liquid ejection head 3300, an ink flow amount obtained by adding the amount of ink (Max. 20 mL/min) used for printing flows into the pressure adjustment mechanism 3230. As a result, a flow amount of the pressure adjustment mechanism 3230 is in a range of 30 to 50 mL/min.

The pressure adjustment mechanism 3230 of the comparative example may control a pressure at an outlet of the pressure adjustment mechanism 3230 (that is, the ink inlet 3321) at a constant value. In the circulation configuration of FIG. 31, the pressure controlled within a certain range at the outlet of the pressure adjustment mechanism 3230 is inhibited from varying in a path to the ink inlet 3321 to the utmost, and thus a filter 3221 at which pressure loss is high is disposed at an upstream side of the pressure adjustment mechanism 3230. According to this configuration, a foreign substance generated inside the pressure adjustment mechanism 3230 arrives at the liquid ejection head 3300 without passing through the filter 3221, and thus the foreign substance enters the liquid ejection head 3300 in some cases.

(Comparison of Pressure Variations Inside Liquid Ejection Head)

Figure 32:
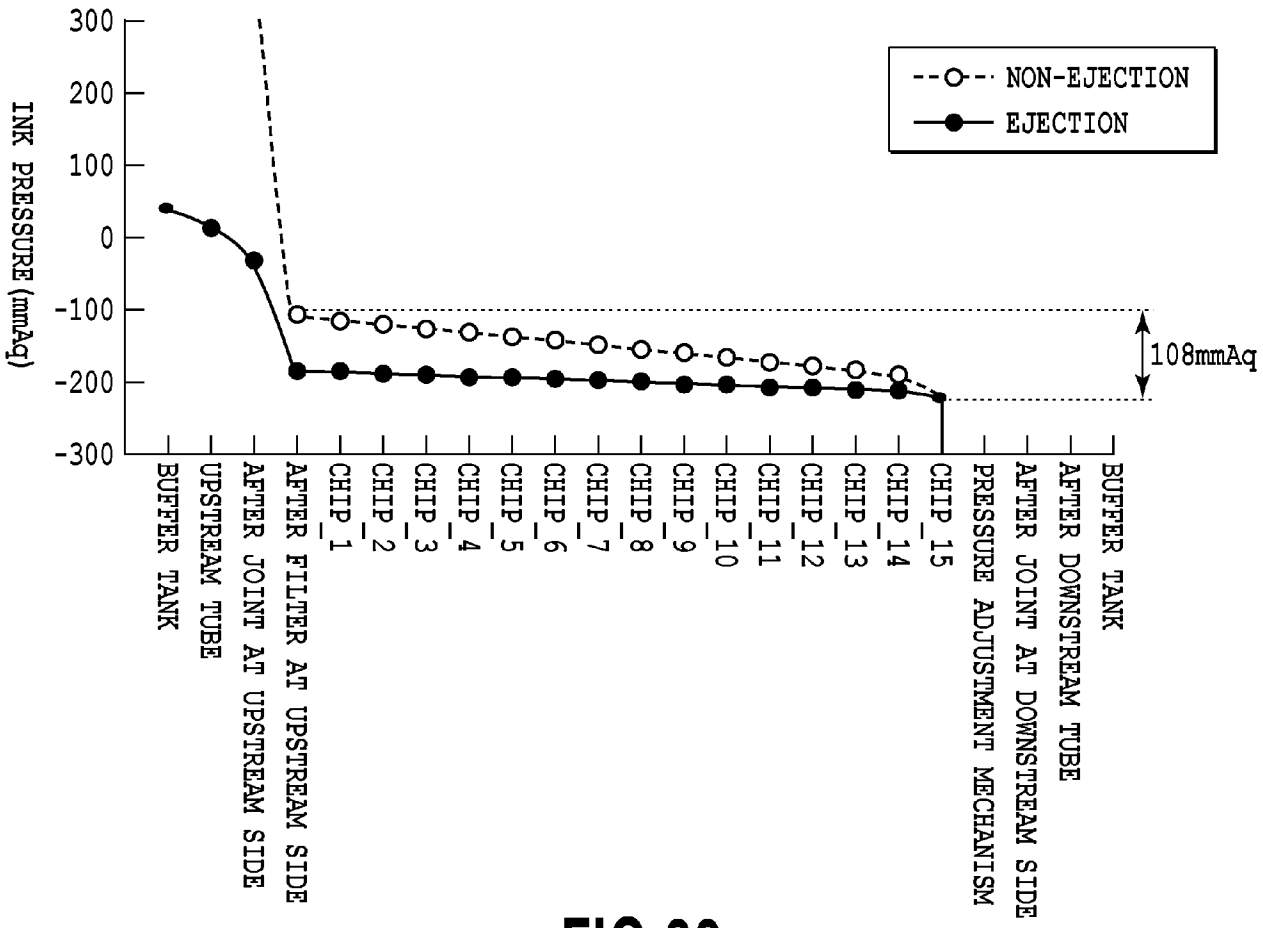
FIG. 32 is a diagram illustrating a pressure distribution inside a common passage in Embodiment 3.
Figure 33:
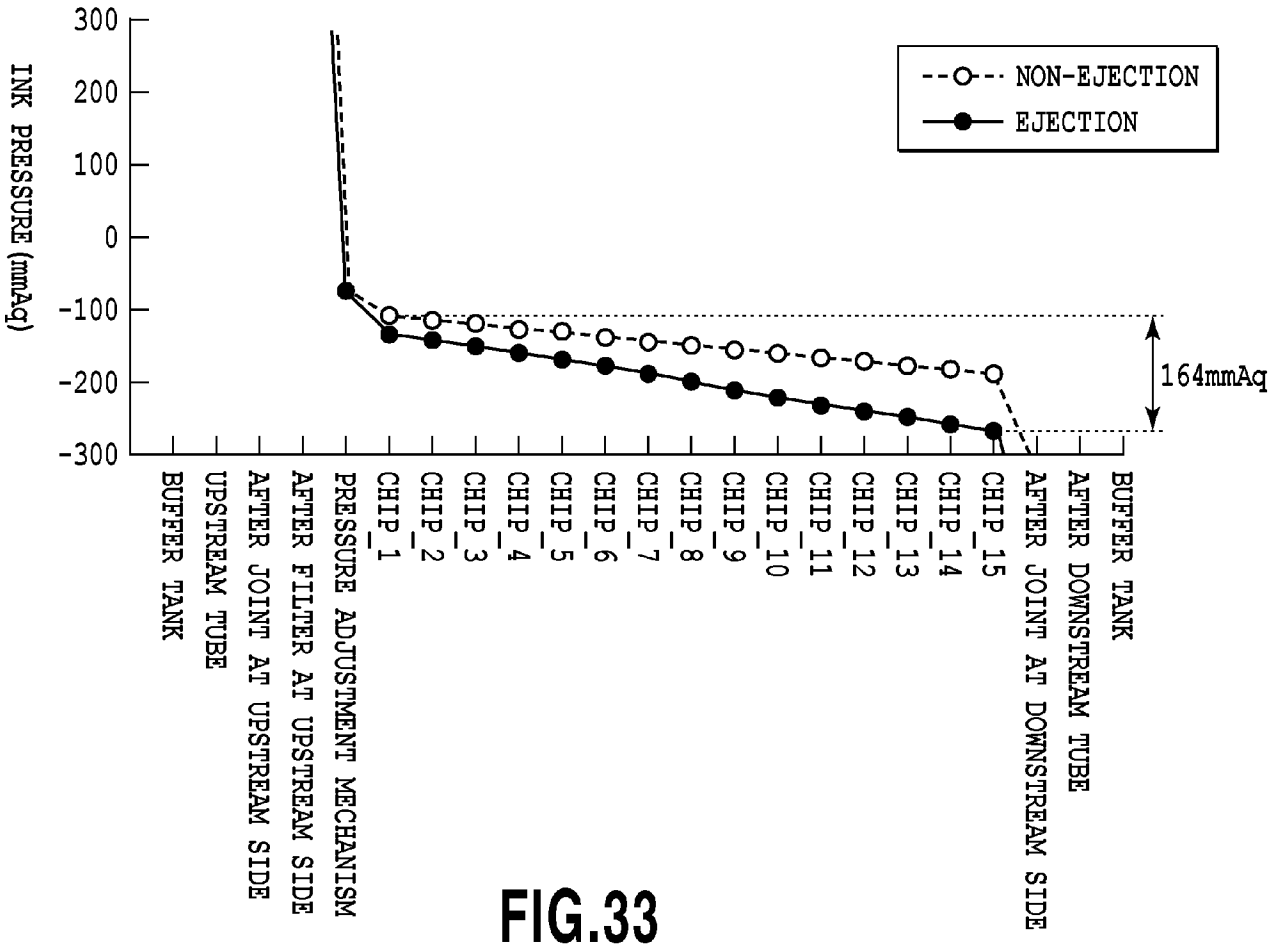
FIG. 33 is a diagram illustrating a pressure distribution inside a common passage in a comparative example.

FIG. 32 and FIG. 33 are diagrams illustrating pressure distributions inside the common passage 3320 in the present embodiment and the comparative example, respectively. Herein, the number of print element boards (hereinafter may be referred to as "chips") mounted in the liquid ejection head 3300 is set to 15, and flow resistance of the ink supply opening 3323 led to the print element boards 3010 is set to 0.2 mmAq·mL/min. As described in the foregoing, while the present embodiment and the comparative example have the same circulation flow amount in the print standby state, a flow amount range is different between the present embodiment and the comparative example. According to this configuration, a difference occurs in the maximum amount of pressure variation inside the liquid ejection head 3300.

As illustrated in FIG. 32 and FIG. 33, while $\Delta P=108$ mmAq in the present embodiment, $\Delta P=164$ mmAq in the comparative example. It can be understood that pressure variation inside the liquid ejection head 3300 may be further suppressed in the present embodiment. This difference in pressure variation increases as viscosity of ink increases. Thus, printing may be performed at high speed to obtain high image quality using more various types of ink in the circulation configuration of the present embodiment.

When a circulation flow amount in the print standby state is decreased, the same pressure variation as that in the present embodiment may be obtained even when the configuration of the comparative example is adopted. However, in particular, in the liquid ejection head 3300 having a thermal type, temperature control is performed using a sub-heater to prevent uneven color in many cases. For this reason, when an ink circulation flow amount is set to be small in the print standby state, a temperature of ink supplied to the print element boards 3010 at the downstream side inside the liquid ejection head 3300 excessively increases. As a result, a difference in temperature inside the liquid ejection head 3300 increases, and there occurs a problem that an image output to a printing medium becomes uneven. This problem slightly differs due to power of the print element board 3010 necessary for ejection, a thermal resistance value inside the liquid ejection head 3300, etc. However, when the same configuration of the liquid ejection head 3300 is used, a circulation amount in the standby state is designed to be the same. For this reason, pressure variation may be invariably suppressed at a low value in the configuration of the present embodiment when compared to the configuration of the comparative example.

When pressure variation inside a further elongated full page wide type liquid ejection head 3300 is suppressed, the pressure adjustment mechanism 3230 is preferably provided at the upstream side of the liquid ejection head 3300 in addition to disposing the pressure adjustment mechanism 3230 at the downstream side of the liquid ejection head 3300. According to this configuration, even though there is a concern that a foreign substance may enter the pressure adjustment mechanism 3230 disposed at the upstream side of the liquid ejection head 3300, pressures at the ink inlet 3321 and the ink outlet 3322 of the liquid ejection head 3300 are controlled at constant values. For this reason, even when the further elongated full page wide type liquid ejection head 3300 is used, pressure variation inside the common passage 3320 is suppressed.

The liquid ejection apparatus of the present invention may print a high-definition image using the page wide type liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-003055 filed Jan. 8, 2016, and No. 2016-239793 filed Dec. 9, 2016, which are hereby incorporated by reference wherein in their entirety.

What is claimed is:

1. A liquid ejection apparatus comprising:

a liquid storage container that stores liquid;

a plurality of print element boards including an ejection opening that ejects liquid and a pressure chamber that includes a print element generating energy for ejecting liquid therein;

a common supply passage that supplies liquid to the plurality of print element boards;

a supply-side filter provided in a passage between the liquid storage container and the common supply passage to remove a foreign substance;

a supply-side pressure adjustment mechanism provided in a passage at a downstream side of the common supply passage to adjust a pressure in the common supply passage;

a common collection passage that collects liquid from the plurality of print element boards;

a collection-side filter provided in a passage between the liquid storage container and the common collection passage to remove a foreign substance; and a collection-side pressure adjustment mechanism provided in a passage at a downstream side of the common collection passage to adjust a pressure in the common collection passage.

2. The liquid ejection apparatus according to claim 1, further comprising:

a plurality of individual supply passages that allows communication between the common supply passage and the plurality of print element boards; and a plurality of individual collection passages that allows communication between the plurality of print element boards and common collection passage.

3. The liquid ejection apparatus according to claim 1, wherein the supply-side pressure adjustment mechanism and the collection-side pressure adjustment mechanism are set to have different control pressures, respectively.

4. The liquid ejection apparatus according to claim 1, further comprising a liquid ejection head including the plurality of print element boards and the common supply passage.

5. The liquid ejection apparatus according to claim 4, further comprising a pump configured to send liquid to the liquid ejection head from the liquid storage container in a passage at a downstream side of the liquid ejection head.

6. The liquid ejection apparatus according to claim 4, further comprising a forcible blocking unit configured to block a passage of liquid inside the pressure adjustment mechanism in a case where the liquid ejection head is filled with liquid.

7. The liquid ejection apparatus according to claim 1, further comprising a liquid ejection head including the plurality of print element boards, the common supply passage, the common supply passage, the common collection passage, the supply-side pressure adjustment mechanism, and the collection-side pressure adjustment mechanism.

8. The liquid ejection apparatus according to claim 1, wherein the liquid inside the liquid storage container is collected to the liquid storage container through the supply-side filter, the common supply passage, the pressure chamber, the common collection passage, and the collection-side pressure adjustment mechanism in order.

9. The liquid ejection apparatus according to claim 1, wherein the liquid inside the liquid storage container has a passage flowing up to the liquid storage container through the supply-side filter, the common supply passage, and the supply-side pressure adjustment mechanism in order without passing through the pressure chamber, and a passage flowing up to the liquid storage container through the collection-side filter, the common collection passage, and the collection-side pressure adjustment mechanism in order without passing through the pressure chamber.

10. The liquid ejection apparatus according to claim 1, wherein both the supply-side pressure adjustment mechanism and the collection-side pressure adjustment mechanism correspond to a back pressure-type pressure adjustment valve mechanism.

11. The liquid ejection apparatus according to claim 10, wherein the back pressure-type pressure adjustment valve mechanism includes a first pressure chamber, a second pressure chamber provided at a downstream side of the first pressure chamber, an orifice provided in a connecting portion between the first pressure chamber and the second pressure chamber, a valve provided inside the first pressure chamber to vary a flow resistance between the first pressure chamber and the second pressure chamber, an urging member that urges the valve in a direction in which a gap between the orifice and the valve is blocked, and a pressure plate shifted depending on an increase or decrease in liquid inside the first pressure chamber.

12. The liquid ejection apparatus according to claim 11, wherein the pressure plate delivers the shift to the valve, and the valve adjusts the gap between the orifice and the valve based on the shift, and varies the flow resistance between the first pressure chamber and the second pressure chamber.

13. A liquid ejection head that ejects liquid of a liquid storage container containing liquid, the liquid ejection head comprising:

a plurality of print element boards including an ejection opening that ejects liquid and a pressure chamber that includes a print element generating energy for ejecting liquid therein;

a common supply passage that supplies liquid to the plurality of print element boards;

a supply-side filter provided in a passage between the liquid storage container and the common supply passage to remove a foreign substance from liquid;

a supply-side pressure adjustment mechanism provided in a passage at a downstream side of the common supply passage to adjust a pressure in the common supply passage;

a common collection passage that collects liquid from the plurality of print element boards;

a collection-side filter provided in a passage between the liquid storage container and the common collection passage to remove a foreign substance; and a collection-side pressure adjustment mechanism provided in a passage at a downstream side of the common collection passage to adjust a pressure in the common collection passage.

14. The liquid ejection head according to claim 13, wherein the supply-side pressure adjustment mechanism and the collection-side pressure adjustment mechanism are set to have different control pressures, respectively.

15. The liquid ejection head according to claim 13, wherein the liquid inside the liquid storage container has a passage flowing up to the liquid storage container through the supply-side filter, the common supply passage, and the supply-side pressure adjustment mechanism in order without passing through the pressure chamber, and a passage flowing up to the liquid storage container through the collection-side filter, the common collection passage, and the collection-side pressure adjustment mechanism in order without passing through the pressure chamber.

16. The liquid ejection head according to claim 13, wherein the liquid ejection head is a page wide type liquid ejection head, and the plurality of print element boards is arranged in a straight line shape.

17. The liquid ejection head according to claim 13, wherein liquid inside the pressure chamber is circulated between an inside and an outside of the pressure chamber.

* * * * *